US005216447A

United States Patent [19]

Fujita et al.

[11] Patent Number: 5,216,447

[45] Date of Patent: Jun. 1, 1993

[54] RECORDING HEAD

[75] Inventors: Kei Fujita, Kokubunji; Hiroshi Nakano, Isehara; Toshihiko Ichise, Kawasaki, all of Japan

[73] Assignee: Canon Kabushiki Kaisha, Tokyo, Japan

[21] Appl. No.: 464,322

[22] Filed: Jan. 12, 1990

[30] Foreign Application Priority Data

| | | | |
|---|---|---|---|
| Jan. 13, 1989 | [JP] | Japan | 1-007445 |
| Jan. 13, 1989 | [JP] | Japan | 1-007446 |
| Jan. 27, 1989 | [JP] | Japan | 1-018011 |
| Jan. 30, 1989 | [JP] | Japan | 1-022287 |
| Jan. 12, 1990 | [JP] | Japan | 2-003365 |

[51] Int. Cl.[5] ..... B41J 2/05

[52] U.S. Cl. ..... 346/140 R

[58] Field of Search ..... 346/140 R; 357/48, 86, 357/44, 46, 51; 307/270, 255

[56] References Cited

U.S. PATENT DOCUMENTS

| | | | |
|---|---|---|---|
| 3,590,345 | 6/1971 | Brewer et al. | 357/48 |
| 3,676,714 | 7/1972 | Weinsink et al. | 357/86 |
| 3,735,481 | 5/1973 | Makimoto | 357/48 |
| 3,761,319 | 9/1973 | Shannon | 357/48 |
| 3,868,722 | 2/1975 | Le Can et al. | 357/44 |
| 3,999,215 | 12/1976 | Aagaard | 357/48 |
| 4,429,321 | 1/1984 | Matsumoto | 346/140 |
| 4,458,256 | 7/1984 | Shirato et al. | 346/140 |
| 4,479,134 | 10/1984 | Kawanabe | 346/140 |
| 4,520,373 | 5/1985 | Ayata et al. | 346/140 |
| 4,567,493 | 1/1986 | Ikeda et al. | 346/140 |
| 4,719,477 | 1/1988 | Hess | 346/140 R |

FOREIGN PATENT DOCUMENTS

| | | |
|---|---|---|
| 0235827 | 9/1987 | European Pat. Off. . |
| 2326672 | 12/1973 | Fed. Rep. of Germany . |
| 1427261 | 3/1976 | United Kingdom . |

OTHER PUBLICATIONS

Hamilton, D. J. & Howard, W. G., "Basic Integrated Circuit Engineering" McGraw-Hill Book Co. 1975, pp. 265-266.

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus having a recording head wherein an electrothermal converting element for generating the emission energy and a semiconductor functional element are integrally formed within a semiconductor substrate. The functional element with its base and collector shorted is electrically connected to the electrothermal converting element. Thereby, variation in ink emission is limited so that the recording head can record high quality images.

18 Claims, 15 Drawing Sheets

RECORDING HEAD

BACKGROUND OF THE INVENTION

1. Field of the Invention

The present invention relates to a recording. head for use in a copier, a facsimile, wordprocessor, an output printer of terminal of host computer, or video output printer, in particular to a recording head and recording apparatus wherein an electrothermal converting element and a recording element are formed on a common substrate.

2. Related Background Art

Hitherto, there has been known a semiconductor device in which a plurality of semiconductor elements are arranged and are simultaneously or solely made operative, thereby controlling a current supply to each segment to be controlled.

FIG. 1A shows an example of such a semiconductor device. In the diagram, reference numeral 24 denotes an insulative substrate; 25 a semiconductor substrate; 26 an anode semiconductor region; 27 a cathode region.

The above semiconductor device has a feature such that it has a construction in which individual diodes are respectively arranged at intervals on the insulative substrate and are adhered thereto. Since the device has the above construction, a degree of freedom for a requirement of the standards for the diodes is large and a proper diode can be selected in a wide range in accordance with the use object. Further, since an electrical mutual interference between the diodes can be prevented, a high reverse bias voltage can be blocked by the insulative substrate and a large current can be supplied and a semiconductor device which has a high withstanding voltage and can endure a large current is realized.

FIG. 1B is a diagram showing an example of an electric circuit using the semiconductor device shown in FIG. 1A.

In such a circuit, for instance, to supply a current to a segment 28 such as a load resistor or the like, a switch 29 is closed, a positive potential $H_1$ is biased, and further, a switch 30 is closed, thereby turning on a diode 31 corresponding to the segment to be supplied with a current. At this time, only the desired segment 28 can be solely made operative without influencing the other segments.

In the recording head also, the above described circuit structure is used. Respective segments, such as electrothermal converting elements, are electrically connected to respective diodes so that the segment can be solely made operative.

However, in the above conventional example, since the individual semiconductor elements have been arranged on the insulative substrate, there are the following technical problems.

① Since the individual diodes are arranged on the insulative substrate one by one and are adhered thereto, the number of necessary steps is very large and the costs of the semiconductor device are high.

② Since the individual diodes are used, there is a large deviation among the characteristics of the diodes. In the case of using a number of diodes, a degree of allowance cannot be set to a large value in consideration of the whole balance in designing of the system.

③ When executing the bonding to electrically couple the diodes, it is necessary to consider a space and a layout upon arrangement of the diodes and it is also necessary to provide gaps to electrically isolate the diodes. Thus, a yield per unit area decreases and the miniaturization of the whole semiconductor device is limited.

In order to solve the above problems ①-③, it seems desirable to form respective elements on a common substrate as disclosed in U.S. Pat. No. 4,429,321 (Matsumoto).

In the case where transistors are arranged in the semiconductor substrate and a circuit is constructed as shown in FIG. 1C, if there is a variation in current amplification factors of the transistors, a current concentration occurs in the diode having a large predetermined current amplification factor.

In the case where the above-mentioned semiconductor device is used in a recording head such as an ink jet recording head comprising a discharge opening to discharge an ink, a liquid passage communicated with the discharge port, and an electrical/thermal converting element serving as a discharge energy generating element which is provided within inside of or outside of a liquid path in correspondence to the discharge port or in a thermal head which is used for thermal copy transfer recording, thermal recording, or the like, it is difficult to avoid the enlargement and high costs of the recording head due to the above causes and, further, the whole recording apparatus increases in size and costs.

Particularly, in the recording head which is used in the ink jet recording apparatus, it has been found from many experiments that the construction of the recording head must be determined by sufficiently considering an influence by the heat which is generated in the semiconductor device, an influence by the heat generation of the electrical/thermal converting element, and the like in order to use a liquid (ink).

That is, when the head structure is such that the electrothermal converting element for generating thermal energy and the semiconductor functional elements are formed on a common semiconductor substrate, an image quality would vary greatly with an electric wiring, element structure and driving conditions. In concrete, a variation in emitted ink adhesion position on recording paper would be greatly changed. Therefore, in order to achieve high quality ink jet recording, a structure for minimizing the variation of dots is desired.

SUMMARY OF THE INVENTION

The present invention is made in consideration of the foregoing technical subjects.

It is an object of the invention to provide a semiconductor device of low costs which can be relatively easily manufactured.

Another object of the invention is to provide, in particular, a semiconductor device having a plurality of elements in which a variation among the elements is suppressed and the device comprises uniform elements.

The third object of the invention is to provide miniaturized semiconductor devices having a high degree of integration.

The fourth object of the invention is to provide an efficient semiconductor device which can suppress a leakage current due to a parasitic PN junction structure.

The fifth object of the invention is to provide, in particular, a semiconductor device having a plurality of elements in which an influence on the adjacent element is prevented and a malfunction of the device does not occur.

The sixth object of the invention is to provide a recording head which has excellent discharging characteristics and can record at a high speed with a high resolution.

Further object of the present invention is to provide, as a means for solving the above described problems, a recording head having a semiconductor substrate, transistor elements provided on the semiconductor substrate, and electrical/thermal converting elements provided on the semiconductor substrate, wherein the recording head has a first wiring electrode in which a base and a collector of each transistor element are short-circuited, a second wiring electrode which is electrically connected to the semiconductor substrate, and a third wiring electrode which is connected to one of electrodes of the electrical/thermal converting elements, and an emitter of the transistor element and the other electrode of the electrical/thermal converting elements are electrically connected.

Further object of the present invention is to provide a recording head comprising:

a semiconductor substrate;

transistor elements provided on the semiconductor substrates; and electrical/thermal converting elements provided on the semiconductor substrate, wherein the recording head has a first wiring electrode which is electrically connected to one of a pair of electrodes of the electrical/thermal converting elements and a second wiring electrode which is electrically connected to the emitters of the transistor elements, and the base and the collector of each transistor element are short-circuited and are electrically connected to the other one of the pair of the electrodes of the electrical/thermal converting elements.

According to the present invention, since a plurality of elements can be formed in the substrate of the recording head by the same step, the high density, high performance, and miniaturization of the recording head can be realized by low costs.

According to another embodiment, since the collector and the base of the transistor for driving the energy generating elements are electrically short-circuited, even if there is a variation among current amplification factors of the transistors forming a plurality of diodes, a current concentration does not occur in the diode having a predetermined large current amplification factor. Thus, the energy generating elements and the semiconductor elements are not destroyed.

On the other hand, according to the embodiment, the semiconductor elements and the energy generating elements can be formed on the same substrate and the high density, high performance, and miniaturization of the recording head can be realized. Further, according to a circuit construction of the embodiment, a liquid droplet which is always stable and has excellent discharge response characteristics can be formed at a high speed.

Further, according to the circuit structure of the present invention, a liquid droplet always stable can be formed with excellent response and with high speed.

DETAILED DESCRIPTION OF THE PREFERRED EMBODIMENTS

The present invention will be described in detail with reference to the drawings as follows. The present invention should not be limited to the embodiments. Any modification achieving the object of the present invention can be made within the scope of the present invention.

EMBODIMENT 1

Figure 1A:
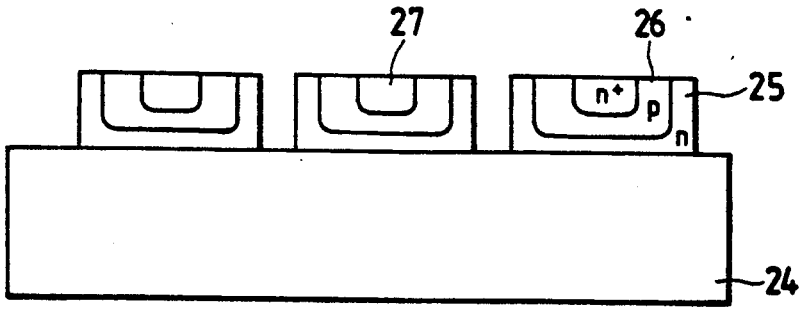
FIG. 1A PRIOR ART
FIG. 1A shows a schematic sectional view of a conventional semiconductor device.
Figure 1B:
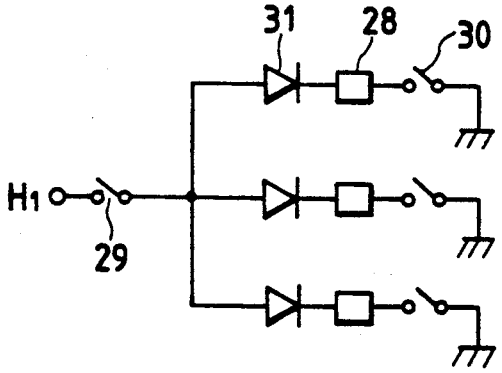
FIG. 1B PRIOR ART
FIG. 1B shows a structure of drive circuit using a semiconductor device.
Figure 1C:
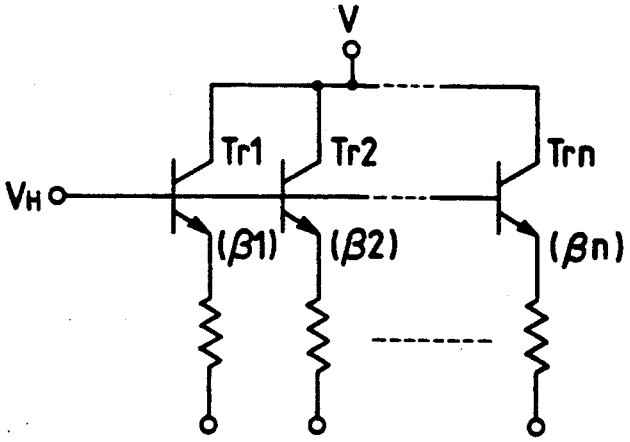
FIG. 1C PRIOR ART
FIG. 1C shows an example of the drive circuit using the semiconductor device.
Figure 2A:
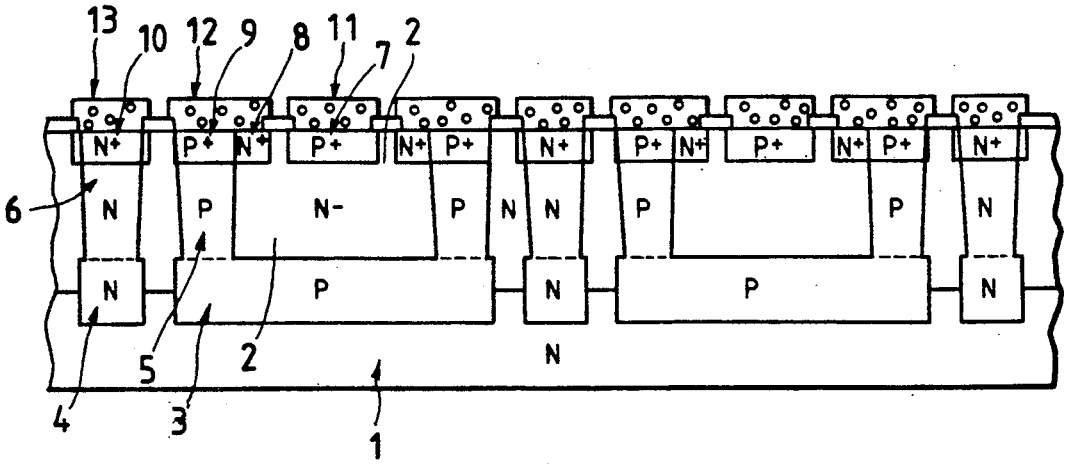
FIG. 2A is a schematic sectional view showing a portion of the semiconductor device for use in a recording head according to first embodiment of the present invention.
Figure 2B:
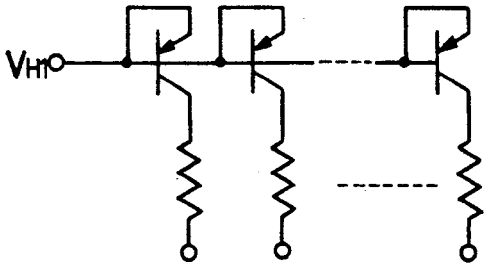
FIG. 2B is a circuit diagram showing a portion of circuit structure of the recording head according to second embodiment of the present invention.

FIG. 2A is a schematic sectional view showing a functional element for use in a recording head of the present invention. In the diagram, reference numeral 1 denotes an N type silicon substrate; 2 an N type epitaxial region constructing elements; 3 a P type collector buried region constituting the elements; 4 an N type isolation region to isolate elements; 5 a P type collector region constructing the elements; 6 a P type isolation region to isolate the elements; 7 an high concentration P type emitter region constructing the elements; 8 a P type base region of a high concentration constructing the elements; 9 a P type isolation region of a high concentration constituting the elements; 10 an N type isolation region isolating the elements. Such functional element operates such that, by forwardly biasing ($V_{H1}$) an electrode 11, by applying biases ($V_{H1}$) of positive potentials to an electrode 11, the PNP transistor in the cell is turned on and bias currents flow out of the emitter electrode 113 as a collector current and a base current. By using the construction wherein base and collector are shorted as in the invention, that is, the construction as shown in FIG. 2B, as a equivalent circuit, the recording head is desirably driven. Thus, a high speed switching property which a recording head requires is obtained. Rising property is desirable. Parasitic effect is relatively small. Accordingly, variation among the elements are small. And stable drive current can be obtained.

In the embodiment, the isolation region is not connected to the ground. In such a semiconductor device, that is, in the semiconductor device in which the isolation region is not connected to the ground, it is desirable to reduce the concentrations of the p type collector buried region 3 among collector region except for high concentration P type collector region, a region comprising the P type collector region 5, a region comprising N type epitaxial region 2 among base region except for high concentration N type base region 8, and N type silicon substrate. This is because it is prevented that charges enter from the P type collector buried region 3 into the P type collector buried region 3 of the other cell through the N type silicone substrate 1.

Figure 3:
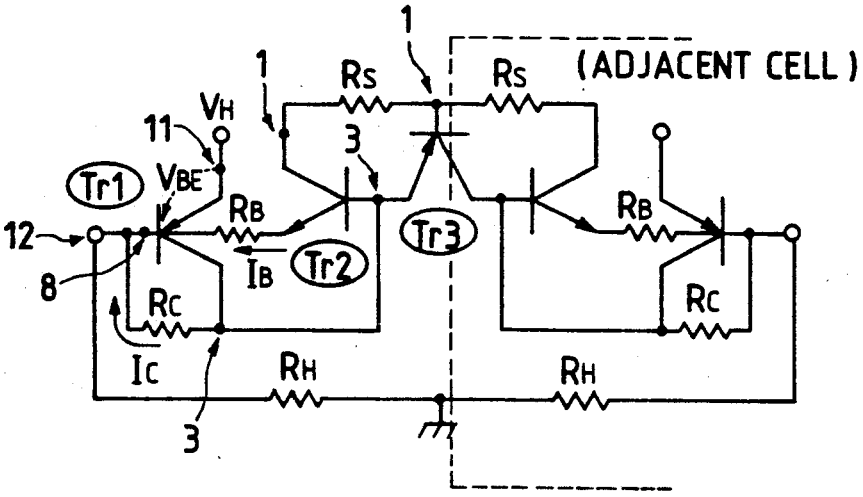
FIG. 3 schematically shows an example of parasitic effect of the semiconductor device.

The reasons will now be described in detail hereinbelow with reference to FIG. 3. FIG. 3 is a diagram showing an equivalent circuit of the semiconductor device together with parasitic effect shown in FIG. 2. In the diagram, $R_C$ denotes the internal resistance of the collector region; $R_{5B}$ indicates the internal resistance of the base region; and $R_S$ represents a resistance of the N type silicone substrate 1. On the other hand, $T_{r1}$ corresponds to a PNP transistor which is formed by the P type emitter region 7, N type epitaxial region 2, and P type collector buried region 3. $T_{r2}$ corresponds to an NPN transistor which is formed by the N type epitaxial region 2, P type collector buried region 3, and N type silicon substrate. Further, $T_{r3}$ corresponds to a parasitic PNP parasitic transistor which is formed by the P type collector buried regions 3 and N type silicone substrate 1 of the adjacent cells.

In the above circuit, when the transistor $T_{r3}$ is turned on, the transistor of the adjacent cell causes a malfunction. To prevent such a malfunction, it is desirable to set the values of $R_C$, $R_B$, and $R_S$ to large values.

(1) The potential on the collector side of the $T_{r1}$ is expressed by $$V_C = V_H - V_{BE(Tr1)} + R_C I_C$$

On the other hand, the potential on the base side of the $T_{r1}$ is expressed by $$V_B = V_H - V_{BE(Tr1)}$$

Therefore, the value of collector-emitter voltage $V_{BE}$ of the $T_{r1}$ decreases as the RC is large, so that the operation of the $T_{r1}$ is set into the saturation region. Therefore, when $R_C$ is greater, the $\beta$ decreases and most of the current from the emitter passes to the base side due to the increase in $\beta$, so that a leakage of the current to the other cell decreases.

(2) Effects which are obtained by increasing the value of $R_B$.

In the case where the current $I_B$ was generated, the emitter potential of the $T_{r2}$ rises as the value of $R_B$ is large, and it becomes difficult to turn on the $T_{r2}$.

(3) If the current flowed by the $T_{r2}$, the potential drop increases as the value of $R_S$ is large, so that the potential of the $T_{r3}$ rises and it becomes difficult to turn on the $T_{r3}$.

As described above, to prevent a malfunction of the adjacent cell, it is desirable to set the values of $R_C$, $R_B$, and $R_S$ to large values, respectively. The values of $R_C$, $R_B$, and $R_S$ can be set to large values by, for instance, reducing the concentrations of the collector region, base region, and N type silicone substrate 1. In the embodiment, the impurity concentrations were set to values within a range from $1\times10^{15}$ to $1\times10^{17}$ $cm^{-3}$.

Figure 4A:
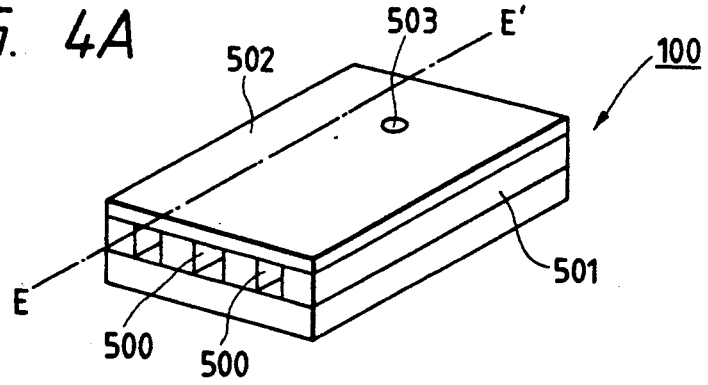
FIG. 4A is a schematic perspective view showing the recording head according to the present invention.

FIG. 4A is a diagrammatical perspective view showing an ink jet recording head according to the invention.

Reference numeral 500 denotes a discharge port to discharge an ink and 501 indicates a liquid passage wall member to form a liquid passage communicating with the discharge port 500. The liquid passage wall member 501 is formed by a photo sensitive resin or the like. Reference numeral 502 indicates a top plate formed by glass, resin, or the like and 503 represents a supply port of a liquid.

Figure 4B:
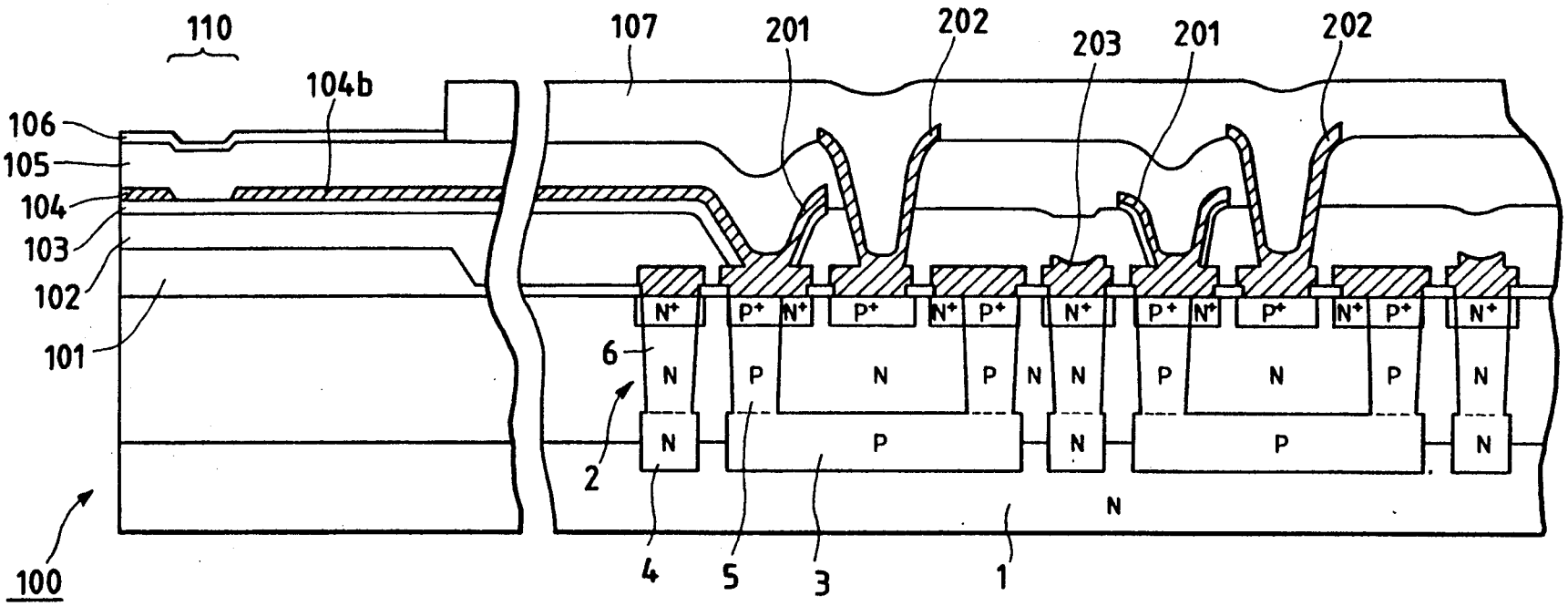
FIG. 4B is a schematic sectional view along a line E—E' in FIG. 4A.
Figure 6A:
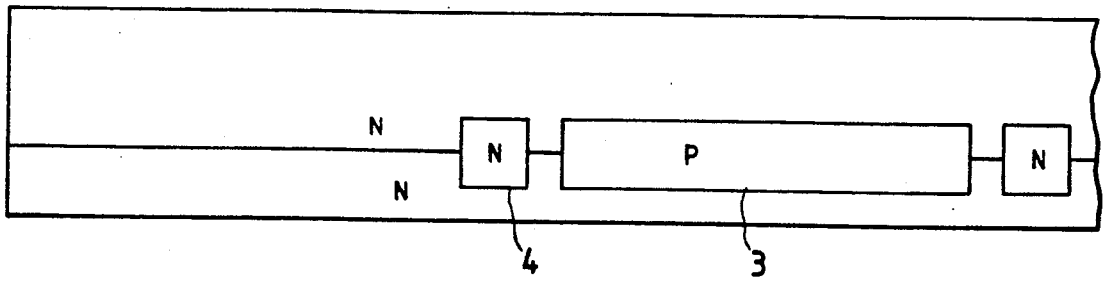
FIGS. 6A–6F schematically show the recording head producing process according to the first embodiment of the present invention.
Figure 6B:
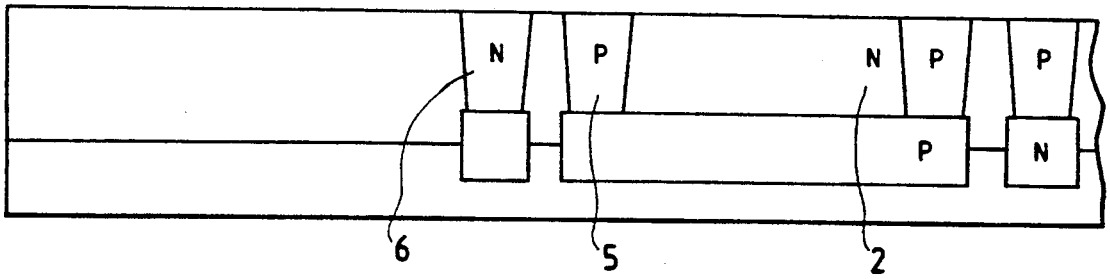
Figure 6C:
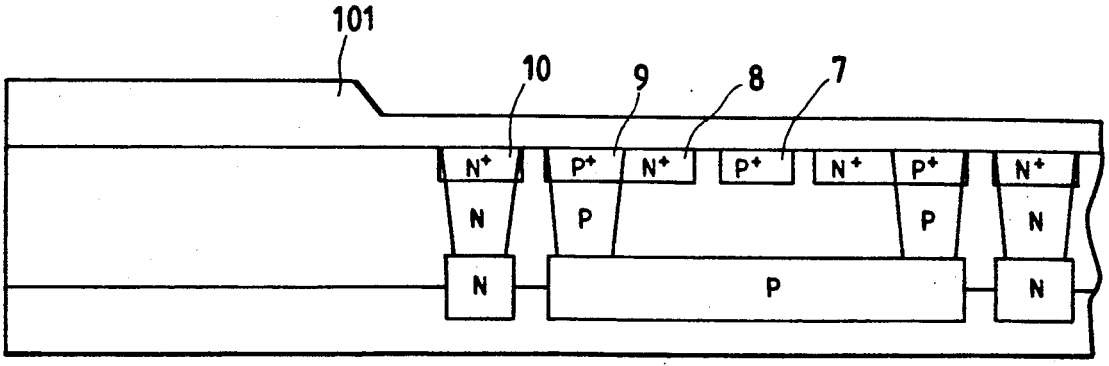
Figure 6D:
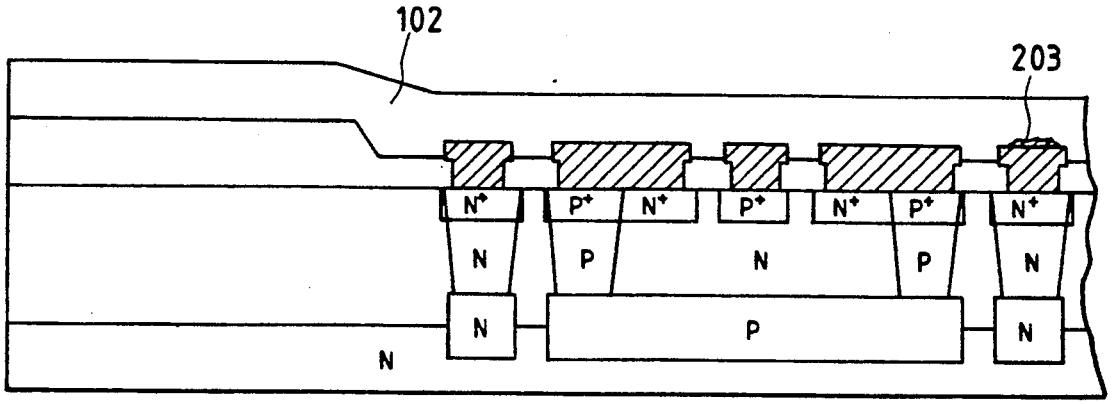
Figure 6E:
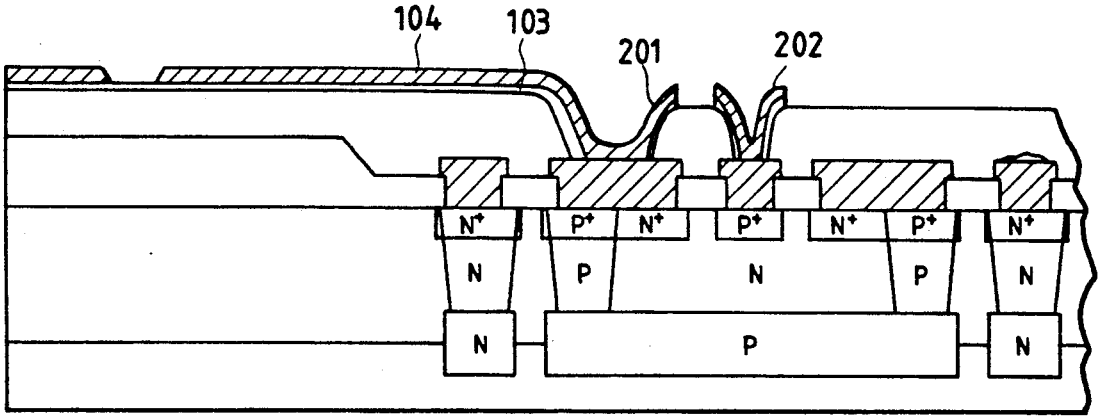
Figure 6F:
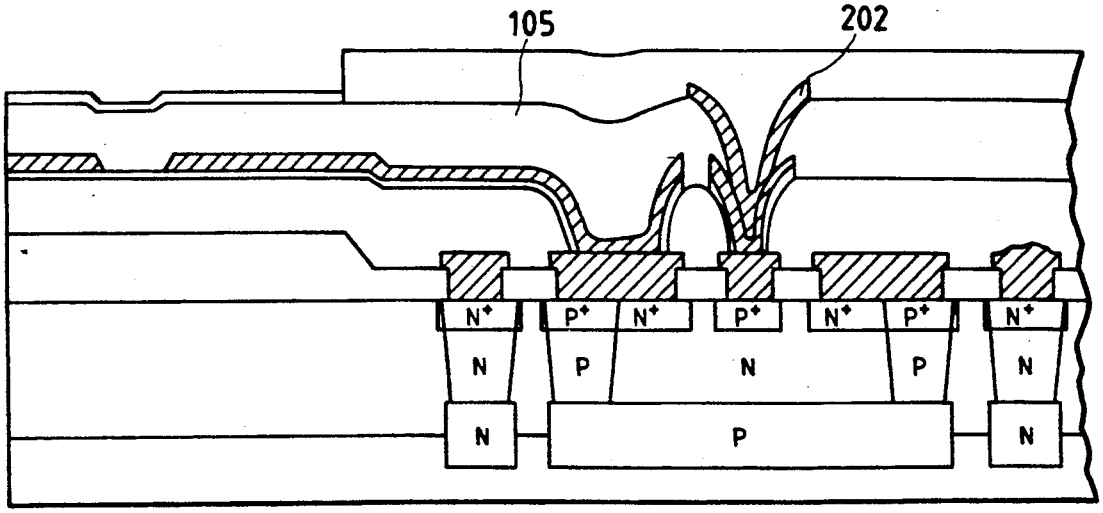

FIG. 4B is a diagrammatical cross sectional view taken along the line E—E' in FIG. 4A showing the ink jet recording head having a drive section of the semiconductor element mentioned above. The liquid passage wall member 501 and the top plate 502 are omitted for simple explanation.

Figure 5:
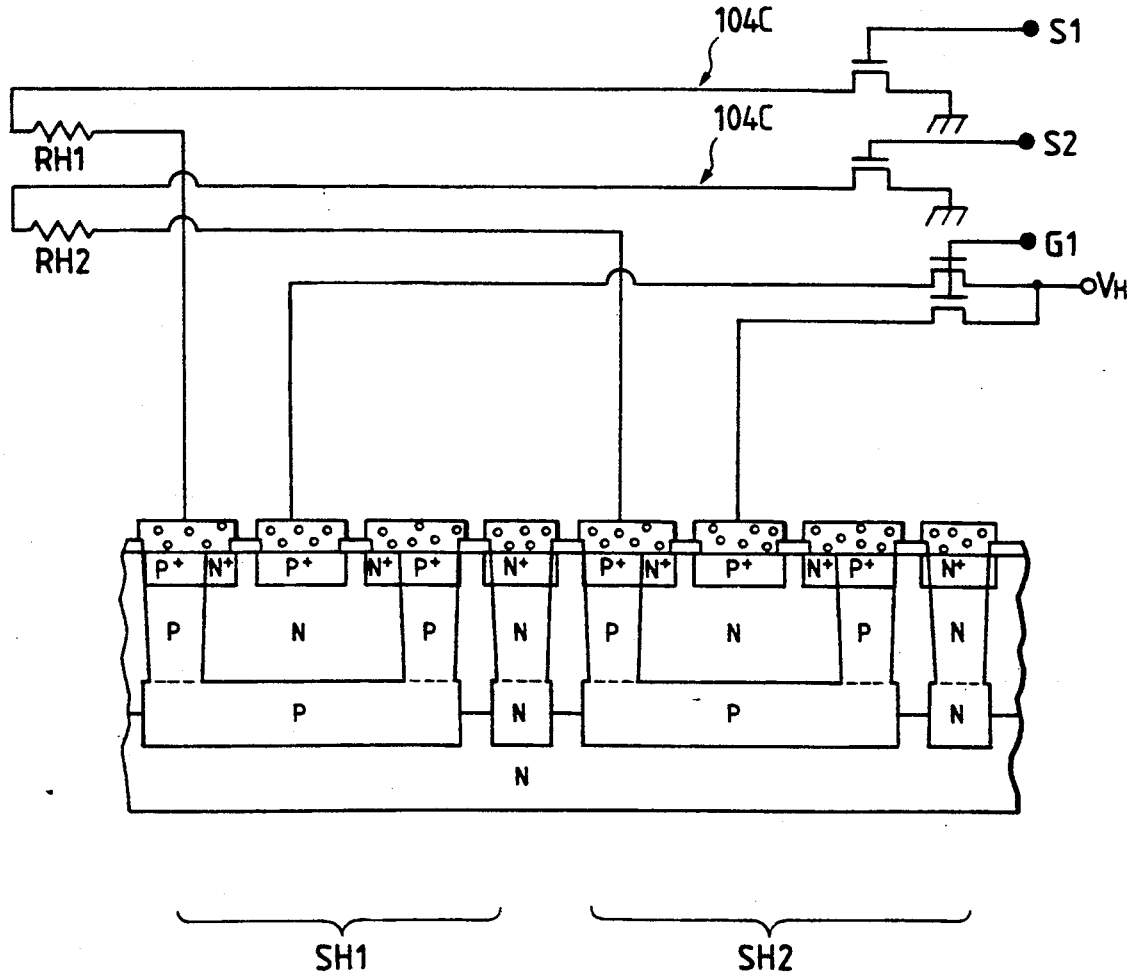
FIG. 5 schematically shows a driving operation of recording head driving method according to the first embodiment of the present invention.

FIG. 5 is a diagram for explaining a method of driving the recording head shown in FIGS. 4A and 4B.

In the recording head 100 of the embodiment as shown in FIG. 4B, an $SiO_2$ film 101 which has the above drive section and is formed by the thermal oxidation is formed on the substrate. An electric/thermal converting element which is formed by a heat generation resistance layer 103 made of $HfB_2$ or the like and an electrode 104 made of Al or the like is provided on a heat accumulation layer 102 comprising an $SiO_2$ film or the like which is formed by a sputtering process on the oxide film. Further, an insulating protective film 105 made of $SiO_2$ or the like and an anti cavitation protective film 106 made of Ta or the like which are formed by the sputtering process are provided on and over a heat generating portion 110 of the electric/thermal converting element.

While, the $SiO_2$ film formed by sputtering and forming the heat accumulation layer 102 is formed integrally with an interlayer insulative film between wirings 201 and 203 of the drive section.

With respect to the protective layer 105 as well, the film is similarly formed integrally with an interlayer insulative film between the wirings 201 and 202.

A protective layer 107 made of an organic material such as photo sensitive polyimide or the like is provided as an insulative film having an excellent recording liquid resistance onto the wiring 202 of the top portion in the drive section.

Apart from the structure shown in FIG. 4A, the recording head can be also constructed in a manner such that a top plate with grooves, an orifice plate, and the like are arranged to form the liquid passage and discharge port although they are not shown. As mentioned above, different from the type in which the liquid is discharged in the direction which is almost parallel with the heat generating surface of the electric/thermal converting element as shown in FIG. 4A, the recording head can be also constructed in a manner such that the liquid is discharged in the direction which crosses the heat generating surface, for example, vertical direction.

The method of driving the recording head will now be described in detail with reference to FIG. 5. Although only two cells have been shown in FIG. 5, a proper number of, e.g., 128 cells as mentioned above are arranged and electrically connected like a M×N matrix.

A method of driving electrothermal resistor elements $RH_1$ and $RH_2$ as two segments among N segments in the group among M groups will now be described.

To drive the electrothermal converting element $RH_1$, first, a desired group is selected by a switch $G_1$, for example, at device body side and the. electrothermal converting element $RH_1$ of the recording head is selected by a switch $S_1$ at device body side. Thus, a diode cell $SH_1$ with a transistor construction is forwardly biased, a current is supplied, and the electrothermal converting element $RH_1$ generates heat. Such a heat energy causes a state change of the liquid, so that film boiling effect is caused and an air bubble is generated and the liquid is discharged from the discharge port.

In a manner similar to the above, even in the case of driving the electrothermal converting element $RH_2$, the switches $G_1$ at the body side and $S_2$ are selectively turned on, a diode cell $SH_2$ at recording head is driven, and a current is supplied to the electrothermal converting element $RH_2$.

A method of manufacturing a semiconductor device according to still another embodiment will now be described with reference to FIG. 6.

(1) A silicon oxide film having a thickness of about 5000 to 20,000 Å was formed by thermal oxidization onto the surface of an N type silicone substrate 1 having an impurity concentration of about $1\times10^{12}$ to $1\times10^{16}$ $cm^{-3}$.

(2) A silicone oxide film to form an N type isolation buried region 4 was eliminated by the wet etching.

(3) A silicone oxide film for a countermeasure for a damage upon ion implantation was formed until a thickness of about 100 to 3000 Å. Impurities for N type conduction type such as P, As, or the like were ion implanted. The N type isolation buried region 4 was formed by the heat diffusion (thickness: 5 to 20 μm, impurity concentration: $1\times10^{15}$ to $1\times10^{17}$ $cm^{-3}$).

(4) Subsequently, an oxide film of the region to form a P type collector buried region 3 was eliminated. P type impurities, such as, B or the like were ion implanted through an oxide film of a thickness of about 100 to 3000 Å. The P type collector buried region 3 was formed by the heat diffusion. A sheet resistance at this time was set to a high value of 1 kΩ/□ or more. A film thickness was set to a value within a range from 10 to 20 μm. An impurity concentration was set to $1\times10^{15}$ $cm^{-3}$ or less. (The above processes correspond to FIG. 6A)

(5) The oxide film on the whole surface was eliminated. An N type epitaxial silicone region 2 of an impurity concentration of about $1\times10^{12}$ to $1\times10^{16}$ $cm^{-3}$ and a thickness of about 5 to 20 μm was epitaxially grown.

(6) Then, a silicone oxide film of a thickness of about 1000 to 10000 Å was formed on the epitaxial region surface. The oxide film of the region to form a P type collector region 5 was eliminated by the wet etching. P type impurities were ion implanted through the silicone oxide film having a thickness of about 100 to 3000 Å which had newly been formed. The P type collector region 5 was formed by the heat diffusion so as to reach a P type collector buried region of an impurity concentration of about $1\times10^{17}$ $cm^{-3}$ (film thickness: 5 to 10 μm). A sheet resistance at this time was set to 1 kΩ/ϵ or more.

(7) The region to form an N type isolation region 6 was eliminated by the wet etching. A phosphorus glass (PSG) film was formed onto the whole surface, thereby implanting P ions into the epitaxial region. The N type isolation region 6 of an impurity concentration of about $1\times10^{14}$ to $1\times10^{16}$ $cm^{31\ 3}$ was formed by the heat diffusion until a thickness of 1 μm or less. (The above processes correspond to FIG. 5B)

(8) Subsequently, the oxide film of the cell region was eliminated by the wet etching. A silicone film having a thickness of 100 to 3000 Å was formed. A resist was patterned. P type impurities were ion implanted into only the regions to form a P type emitter region 7 and a high concentration P type collector region 9. The resist was eliminated. The regions to form a high concentration N type base region 8 and a high concentration N type isolation region 10 were eliminated by the wet etching. A PSG film was formed onto the whole surface. P ions were implanted. The P type emitter region 7, high concentration P type collector region 9, high concentration N type base region 8, and high concentration N type isolation region 10 were simultaneously formed (a film thickness of each of the regions was set to 1 μm or less and an impurity concentration was set to a value within a range from $1\times10^{19}$ to $1\times10^{20}$ $cm^{-3}$, respectively).

(9) The silicone oxide film at the connecting position of each electrode was eliminated. Pure Al was deposited onto the whole surface. The surplus Al layers of the regions other than the electrodes were eliminated. To raise the junction performance between Al and silicone, the alloy process was executed and the wiring portions were formed. An $SiO_2$ film 101 was formed on the above regions by the sputtering process. (The above processes correspond to FIG. 6C)

A wiring 203 which is electrically connected to the substrate 1 through the isolation region 4 was formed. An $SiO_2$ film 102 serving as a heat accumulation layer and an interlayer insulative film was formed onto the whole surface by the sputtering process until a thickness of about 1.0 μm. (The above processes correspond to FIG. 6D)

Next, $HfB_2$ of a thickness of about 1000 Å was deposited as a heat generation resistance layer 103. A pair of electrodes 104*a* and 104*b* of the electric/thermal converting element and Al wirings serving as an anode electrode wiring 201 and a cathode electrode wiring 202 of the diode were deposited onto the heat generation resistance layer 103 and patterned.

After that, an $SiO_2$ film 105 as a protective layer of the electric/thermal converting element and as an insulative layer between the Al wirings was deposited by the sputtering process. Contact holes were formed. The cathode electrode wiring 202 was formed. A Ta layer of a thickness of about 2000 Å as a protective layer for the anti-cavitation was deposited in the upper portion of the heat generating section of the electric/thermal converting element. Further, photo sensitive polyimide as a protective layer was formed onto the $SiO_2$ film 105 and cathode electrode wiring 202. (The above processes correspond to FIG. 6F)

A recording head as shown in FIG. 4A was manufactured by arranging the liquid passage wall member and the top plate to the substrate having the electric/thermal converting element and the semiconductor element which had been formed as mentioned above.

With respect to the recording head using the semiconductor device according to the embodiment which was manufactured by the method described above, the cells having a plurality of elements of FIG. 2B were connected like a matrix and the operation experiments were executed. Even when a current of 300 mA (total 2.4 A) was allowed to flow through each of eight semiconductor diodes, the other diodes did not cause a malfunction and a liquid droplet could be preferably discharged.

Although the embodiment has been described with respect to the case where the diode has been formed by the PNP transistor, the similar advantages can be also obtained even in the case of using the NPN transistor.

As described above, according to the embodiment using a plurality of semiconductor elements each having a high withstanding voltage and each of which is excellent in electrical isolation performance, every element can be formed on the single substrate. Therefore, for instance, in the circuit comprising the semiconductor elements which were connected like a matrix, there is no need to individually connect the elements from the outside and the number of steps can be reduced. Thus, the number of failure occurrence positions can be decreased and the high reliability can be assured.

On the other hand, according to the embodiment, the semiconductor element and the electric/thermal converting element which is driven by the semiconductor element can be formed on the same substrate. Therefore, it is possible to obtain the recording head in which the area of the circuit can be reduced, the number of steps can be decreased, the reliability can be improved, and a recording image of a high resolution can be formed.

The embodiment can be applied to semiconductor devices in various application fields. For instance, the embodiment can be also applied as a diode for a micro current. The embodiment can be also applied to a diode for a large current. However, as large advantages of the invention, there can be mentioned effects such that the semiconductor device of the embodiment is excellent in a withstanding voltage and can be used by a large current. Therefore, the most typical advantages of the embodiment can be obtained in the case where it is used as a device for a large current.

Further, in the case where a transistor is used as a semiconductor element, a drive voltage is applied to an emitter, a base and a collector are short-circuited, and an electric/thermal converting element is connected, since no minority carrier enters between the base and collector, the switching speed is high, the rising speed is improved, the parasitic effect is also lightened, a thermal energy suitable for a liquid can be applied, and good discharge characteristics can be obtained.

EMBODIMENT 2

Figure 7A:
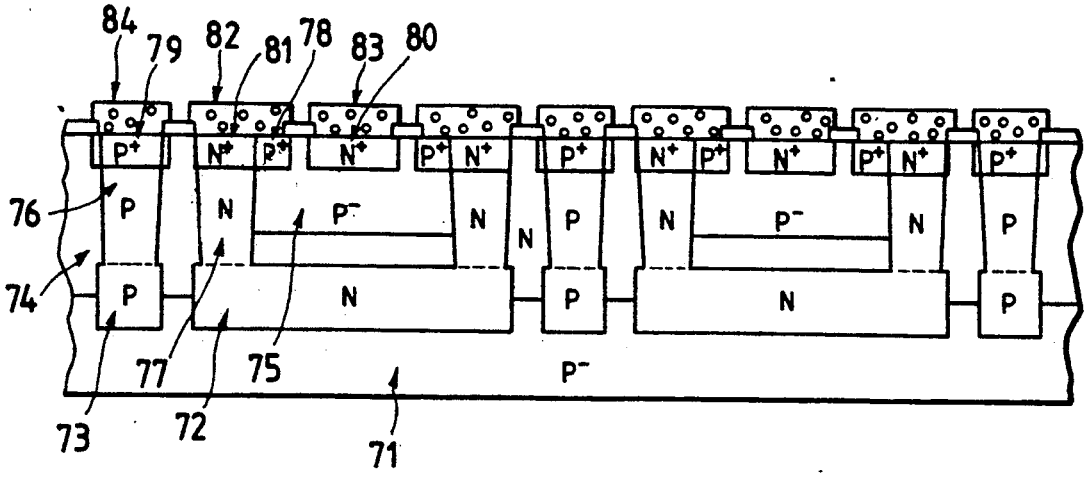
FIG. 7A is a schematic sectional view showing a portion of the semiconductor device for use in the recording head according to second embodiment of the present invention.

FIG. 7A shows a driving portion for driving the recording head according to the present invention. In the diagram, reference numeral 71 denotes a P type silicone substrate; 72 an N type collector buried region constructing elements; 73 a P type isolation buried region to separate the elements; 74 an N type epitaxial region; 75 a P type base region constructing the elements; 76 a P type isolation region to separate the elements; 77 an N type collector region constructing the elements; 78 a P type base region of a high concentration constructing the elements; 79 a P type isolation region of a high concentration to separate the elements; 80 an N type emitter region constructing the elements; 81 an N type collector region of a high concentration constructing the elements; 82 a collector/base common electrode; 83 an emitter electrode; and 84 an isolation electrode. An NPN transistor is formed by the N type collector buried region 72, P type base region 75, and N type emitter region 80. The collector region is formed so as to completely surround the emitter region 80 and the base regions 75 and 78 by the regions 72, 77, and 81. On the other hand, an isolation region is formed as an element separating region by the P type isolation buried region, P type isolation region 77, and high concentration P type isolation region. A plurality of cells mentioned above are formed like a matrix.

Figure 7B:
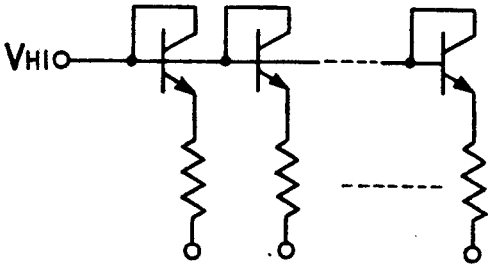
FIG. 7B is a circuit diagram showing a portion of circuit structure of the recording head according to the second embodiment of the present invention.

The fundamental operation of the driving portion with the above construction as an embodiment will now be described. FIG. 7B is a circuit diagram showing a circuit construction of the semiconductor device according to the embodiment. In the embodiment, in FIG. 7A, the collector/base common electrode 82 corresponds to an anode of the diode and the emitter electrode 83 corresponds to a cathode of the diode. That is, by applying biases ($V_{H1}$) of positive potentials to the collector/base common electrode 82, the NPN transistor in the cell is turned on and bias currents flow out of the emitter electrode 83 as a collector current and a base current. By using the construction as in the invention, that is, the construction as shown in FIG. 7B wherein the base and collector are shorted, high speed switching is achieved, desired rising property is obtained, a variation among the elements is eliminated and a stable construction is derived. For the embodiment, further, by connecting the isolation electrode 84 to the ground, the inflow of the charges to the other adjacent cell can be prevented and the problem of the malfunction of the other bits can be prevented.

In the above semiconductor device, it is desirable to set a concentration of the N type collector buried region 72 to a value of $1\times10^{19}$ $cm^{-3}$ or more. On the other hand, it is desirable to set a concentration of the base region 5 to a value within a range from $1\times10^{13}$ $cm^{-3}$ to $1\times10^{15}$ $cm^{-3}$. Further, it is also preferable to reduce an area of the junction surface between the high concentration base region 78 and the electrode as small as possible. This is because the generation of a leakage current which flows from the NPN transistor to the ground (GND) through the P type silicone substrate 71 and the isolation region 73, 74, 76 is prevented.

The reasons why the generation of such a leakage current is prevented will now be described in detail hereinbelow with reference to FIG. 8.

Figure 8:
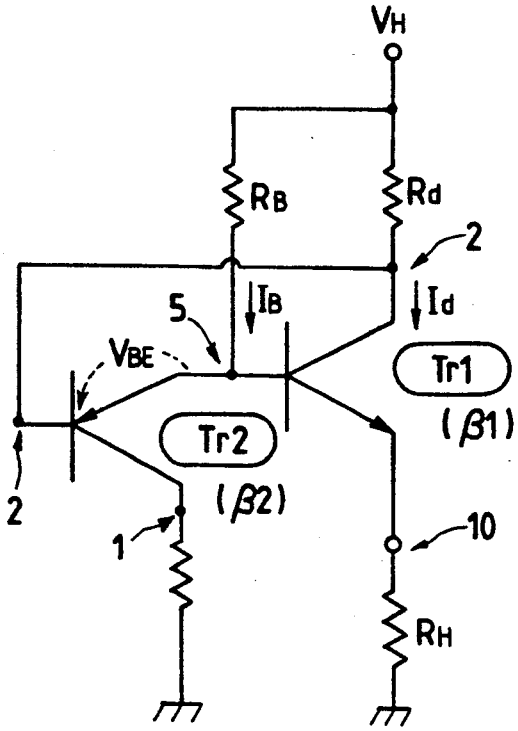
FIG. 8 schematically shows an example of a parasitic effect of the semiconductor device.

FIG. 8 is a diagram showing an equivalent circuit of the semiconductor device shown in FIG. 7A.

In the diagram, $R_d$ denotes an internal resistance of the collector region (the region comprising the N type collector buried region 72, N type collector region 77, and high concentration N type collector region 81) and $R_B$ indicates an internal resistance of the base region (the region comprising the P type base region 75 and high concentration P type base region 78), respectively. $T_{r1}$ corresponds to an NPN transistor which is formed by the N type collector buried region 72, P type base region 75, and N type emitter region 80. Further, $T_{r2}$ indicates a PNP transistor which is formed by the P type base region 75, N type collector buried region 72, and P type silicone substrate 71. That is, $T_{r2}$ represents a transistor structure which results in a cause of the leakage current.

In the above circuit (namely, the driving portion of the recording head), when the parasitic transistor $T_{r2}$ is turned on, most of the bias current leaks to the substrate 71 and flows out to the GND through a collector and an emitter of the transistor $T_{r2}$. In this case, to obtain a necessary emitter current of the transistor $T_{r1}$, an extremely large bias current is needed, so that an efficiency deteriorates, an electric power consumption increases, and costs of the power source also rise.

The following countermeasures are considered for the above problems. (1) A base voltage of the transistor $T_{r2}$ is set to be higher than the emitter voltage so as not to turn on the $T_{r2}$. (2) To reduce the current (leakage current) which flows out of the $T_{r2}$, a current amplification factor ($\beta_2$) of the $T_{r2}$ is set to a small value.

The countermeasure (1) will be first described.

In FIG. 2, to inhibit that the $T_{r2}$ is turned on, $$V_{BE(Tr2)} \geqq 0 \quad (1)$$

must be satisfied with respect to the voltage $V_{BE(Tr2)}$ between the base and emitter of the $T_{r2}$.

Now, $$I_C = \beta_1 \cdot I_B$$

$$V_{B(Tr2)} = V_H - I_C \cdot R_C$$

$$V_{E(Tr2)} = V_H - I_B \cdot R_B$$

Therefore, $$\begin{aligned} V_{BE(Tr2)} &= V_{B(Tr2)} - V_{E(Tr2)} \\ &= V_H - I_C \cdot R_C - (V_H - I_B \cdot R_B) \\ &= I_B \cdot R_B - I_C \cdot R_C \\ &= (R_B - \beta_1 R_d) I_B \end{aligned}$$

Thus, to satisfy the equation (1), $$R_B \geqq \beta_1 \cdot R_C$$

necessary. In other words, to inhibit that the $T_{r2}$ is turned on, it is necessary to set the resistance $R_B$ of the base region to a value which is $\beta_1$ or more times as large as a resistance $R_C$ of the collector region. In order to satisfy the condition, in the semiconductor device shown in FIGS. 7A and 7B, the resistance ($R_C$) of the collector region is reduced, for example, by increasing the concentration of the N type collector buried region 72. Or, to increase the resistance ($R_B$) of the base region, for example, the concentration of the high concentration P type base region 78 is reduced or the area of the base region 78 is decreased.

The countermeasure (2) will now be described.

Even in the case where the condition of the countermeasure (1) is not satisfied, that is, even when $$V_{BE(Tr2)} \leqq 0$$

if $\beta_2 << 1$, the leakage current to the P type silicone substrate 71 can be suppressed. To set the current amplification factor $\beta_2$ of the transistor $T_{r2}$ to a small value, for instance, it is sufficient to increase the concentration of the base region (N type collector buried region 2) of the $T_{r2}$.

That is, the method whereby the concentration of the N type collector buried region 72 is increased has an effect for both of the countermeasures (1) and (2).

Due to the above reasons, in the embodiment, the impurity concentration of the N type collector buried region 72 was set to $1 \times 10^{19}$ cm$^{-3}$ or more and, further, the impurity concentration of the P type base region 5 was set to a value within a range from $1 \times 10^{13}$ cm$^{-3}$ to $1 \times 10^{15}$ cm$^{-3}$.

FIG. 4A is a diagrammatical perspective view showing an ink jet recording head according to the embodiment.

Figure 9:
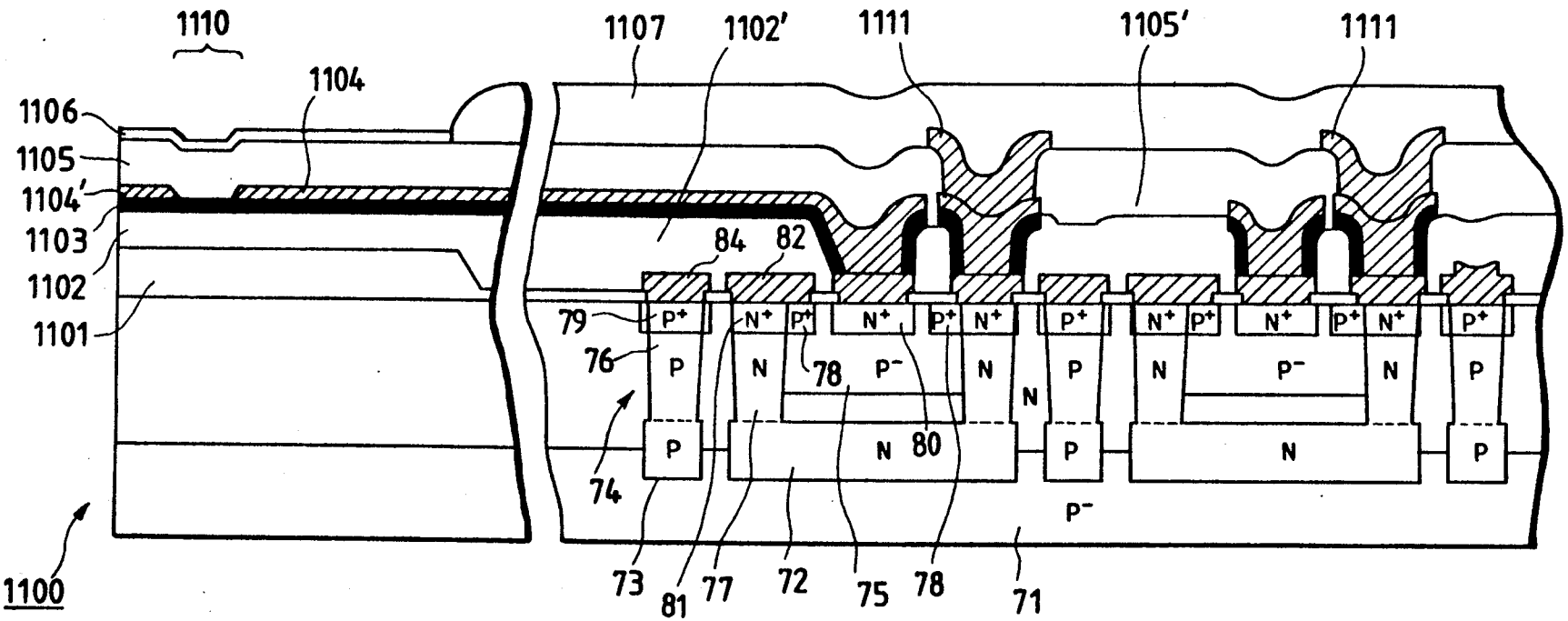
FIG. 9 is a schematic sectional view showing a substantial structure of the recording head according to the second embodiment of the present invention.

FIG. 9 is a diagrammatical cross sectional view taken along the line E–E' in FIG. 4A showing the ink jet recording head having a drive section of the semiconductor element mentioned above.

Figure 10:
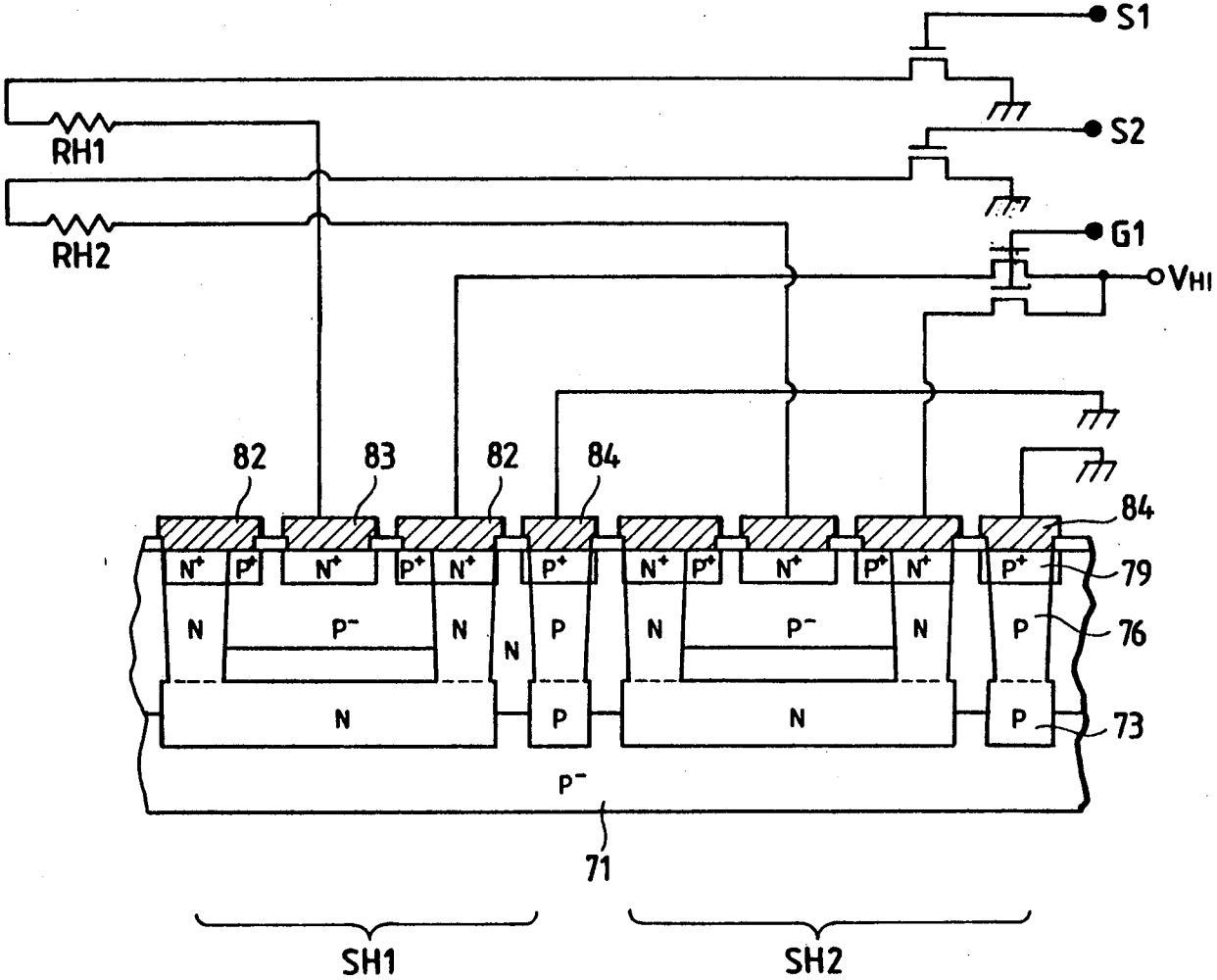
FIG. 10 schematically shows recording head driving method according to the second embodiment of the present invention.

FIG. 10 is a diagram for explaining a method of driving the recording head shown in FIG. 9.

In the recording head 1100 of the embodiment, an $SiO_2$ film 1101 which has the above function element and is formed by the thermal oxidation is formed on the substrate. An electric/thermal converting element which is formed by a heat generation resistance layer 1103 made of $HfB_2$ or the like and an electrode 1104 made of Al or the like is provided on a heat accumulation layer 1102 comprising an $SiO_2$ film or the like which is formed by a sputtering process. Further, a protective film 1105 made of $SiO_2$ or the like and a protective film 1106 made of Ta or the like which are formed by the sputtering process are provided on and over a heat generating portion 1110 of the electric/thermal converting element.

The $SiO_2$ film forming the one heat accumulation layer 1102 of the two is formed integrally with an interlayer insulative film 1102 between wirings 82, 83, 84 and wiring 104 of the electrothermal converting element, second layer wiring, of the drive section, lower wiring.

With respect to the protective layer 105 as well, the film is similarly formed integrally with an interlayer insulative film 1105' between the second wiring 104 and upper layer wiring 1111.

A protective layer 1107 made of an organic material such as photo sensitive polyimide or the like is provided as an insulative film having an excellent recording liquid resistance onto the wiring 1111 of the top portion in the drive section.

Similar to the first embodiment, according to the present embodiment, the recording head can be also constructed in a manner such that a top plate with grooves, an orifice plate, and the like are arranged to form the liquid passage and discharge port although they are not shown. As mentioned above, different from the type in which the liquid is discharged in the direction which is almost parallel with the heat generating surface of the electric/thermal converting element as shown in FIG. 4A, the recording head can be also constructed in a manner such that the liquid is discharged in the direction which crosses the heat generating surface.

The method of driving the recording head will now be described in detail. Although only two cells have been shown in FIG. 10, a proper number of, e.g., 128 elements as mentioned above are arranged and electrically connecting like a MXN matrix.

A method of driving electrothermal resistor elements $RH_1$ and $RH_2$ as two segments among N in the one of M group will now be described.

To drive the electrothermal converting element $RH_1$, first, a desired group is selected by a switch $G_1$ at the apparatus body to connect the desired group to reference potential $V_{H1}$ and the electrothermal converting element $RH_1$ is selected by for example a switch $S_1$ at the apparatus body body to connect the converting element $RH_1$ to another reference potential. Thus, a diode cell $SH_1$ with a transistor construction is forwardly biased, a current is supplied, and the electrothermal converting element $RH_1$ of the recording head generates heat. Such a heat energy causes a state change of the liquid, so that film boiling effect occurs and an air bubble is generated and the liquid is discharged from the discharge port.

In a manner similar to the above, even in the case of driving the electrothermal converting element $RH_2$, the switches $G_1$, for example, at apparatus body and $S_2$ are selectively turned on, a diode cell $SH_2$ at recording head is driven, and a current is supplied to the electrothermal converting element $RH_2$.

When P type semiconductor substrate is used like the present invention, the isolation electrode 84 is maintained at ground potential, thereby the substrate is maintained at the ground potential via the isolation regions 73, 76, 79. Thus, each cell is isolated.

The structure also achieves the following advantageous effect. When the structure is for use in the recording head, the substrate 71 itself partially exposed to outside or exposed via the member of conductive body. Thus, the operator is likely to touch the substrate 71.

Further, as shown in FIG. 4A, when a portion of the substrate 71 is positioned in the vicinity of the emission orifice, an ink and a powder of paper likely adhere. In view of the respect, when P type substrate is used and is maintained at ground potential, the adverse electrostatic effect is prevented, so that the ink degrading and adhesion of foreign matter like the paper powder are completely prevented.

Further, even if the operator touches the substrate, since it is at ground potential, there is no adverse effect to him. The electrical element isolation function which the recording head is required and electrostatic shielding function are simultaneously obtained or satisfied.

Manufacturing processes of the recording head according to the embodiment will now be described.

(1) A silicone oxide film having a thickness of about 5000 to 20000 Å was formed onto the surface of the P type silicone substrate 71 having an impurity concentration of about $1\times10^{12}$ to $1\times10^{16}$ $cm^{-3}$.

The silicone oxide film of the portion to form a collector buried region 702 of each cell was eliminated by a photolithography process.

A silicone oxide film for a countermeasure for a damage upon ion implantation was formed to a thickness of about 100 to 3000 Å. N type impurities such as P, As, or the like were ion implanted. The N type collector buried region 72 having an impurity concentration of $1\times10^{19}$ $cm^{-3}$ or more was formed by the heat diffusion until a thickness of 10 to 20 μm. A sheet resistance at this time was set to a low value of 30 Ω/} or less.

Figure 11A:
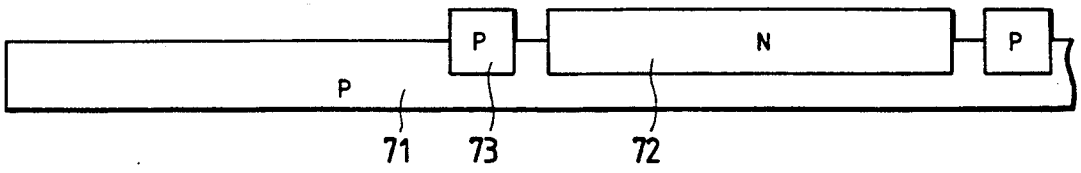
FIGS. 11A–11J are schematic sectional views showing the recording head producing process according to the second embodiment of the present invention.

Subsequently, the oxide film of the region to form the P type isolation buried region 709 was eliminated. An oxide film having a thickness of about 100 to 3000 Å was formed. P type impurities such as B or the like were ion implanted. The P type isolation buried region 73 having an impurity concentration of $1\times10^{17}$ to $1\times10^{19}$ $cm^{-3}$ was formed by the heat diffusion (FIG. 11A).

Figure 11B:
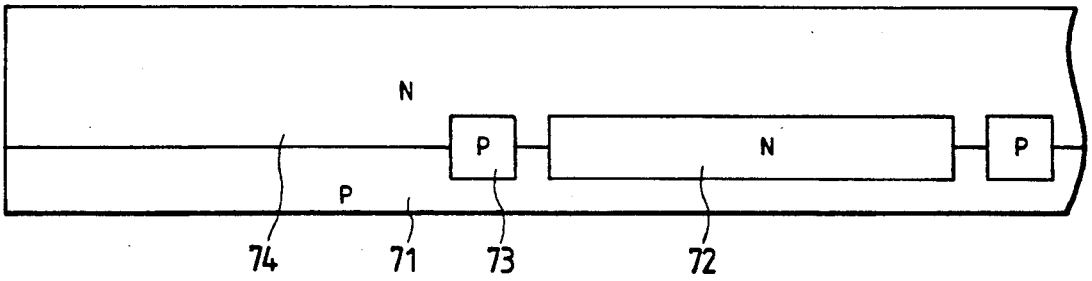
Figure 11C:
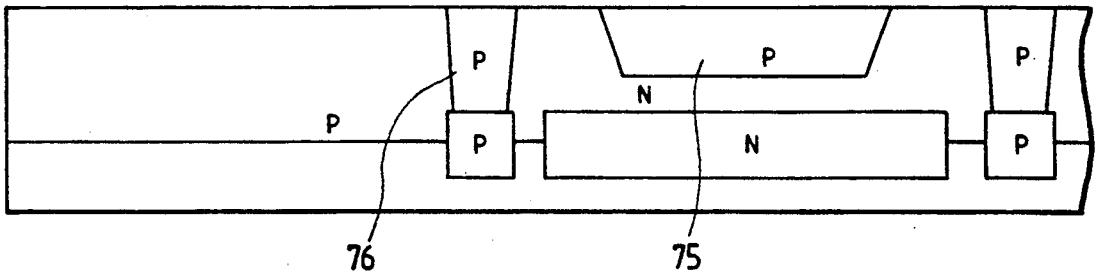

(2) The oxide film on the whole surface was eliminated. The N type epitaxial region 74 having an impurity concentration of about $1\times10^{12}$ to $1\times10^{16}$ $cm^{-3}$ epitaxially grown until a thickness of about 5 to 20 μm. (The above processes correspond to FIG. 11B).

(3) Next, a silicon oxide film having a thickness of about 100 to 300 Å was formed onto the surface of the N type epitaxial region. A resist was coated thereon and patterned. P type impurities were ion implanted into only the region to form a low concentration base region 75. The resist was eliminated. The low concentration P type base region 75 having an impurity concentration of $1\times10^{13}$ to $1\times10^{15}$ $cm^{-3}$ was formed by the heat diffusion until a thickness of 5 to 10 μm.

The oxide film on the whole surface was again eliminated. Further, a silicone oxide film having a thickness of about 1000 to 10000 Å was formed. The oxide film of the region to form the P type isolation region 76 was eliminated. A BSG film (not shown) was deposited onto the whole surface by using the CVD process. The P type isolation region 76 having an impurity concentration of $1\times10^{18}$ to $1\times10^{20}$ $cm^{-3}$ and a thickness of about 10 μm was further formed by the heat diffusion so as to reach the P type isolation buried region 73.

(4) The BSG film (not shown) was eliminated. A silicone oxide film having a thickness of about 1000 to 10000 Å was formed. Further, the oxide film of only the region to form an N type collector region 77 was eliminated. A PSG film was formed, thereby implanting P+ ions The N type collector region 77 was formed by the heat diffusion so as to reach the collector buried region 75. A sheet resistance at this time was set to a low value of 10 Ω/□ or less. On the other hand, a thickness of the N type collector region 77 was set to about 10 μm and an impurity concentration was set to a value of $1\times10^{18}$ to $1\times10^{20}$ $cm^{-3}$.

Figure 11D:
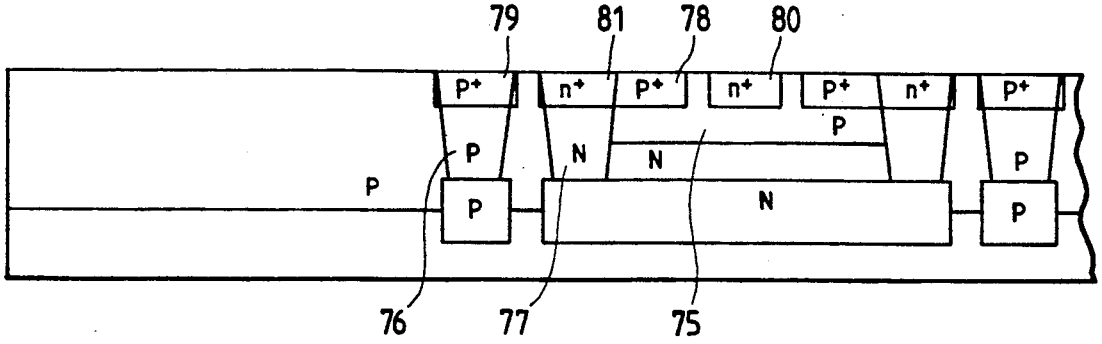

Subsequently, the oxide film of the cell region was eliminated. A silicone oxide film having a thickness of 100 to 3000 Å was formed. A resist was patterned. P type impurities were ion implanted into only the regions to form a high concentration base region 78 and a high concentration isolation region 79. The resist was eliminated. The oxide film of the regions to form an N type emitter region 80 and a high concentration N type collector region 81 was eliminated. A PSG film was formed onto the whole surface. N+ ions were implanted. The high concentration P type base region 78, high concentration P type isolation region 79, N type emitter region 80, and high concentration N type collector region 81 were simultaneously formed by the heat diffusion. A thickness of each of the above regions was set to 1.0 μm or less and an impurity concentration was set to a value within a range from $1\times10^{19}$ to $1\times10^{20}$ $cm^{-3}$. (The above processes correspond to FIG. 11D).

Figure 11E:
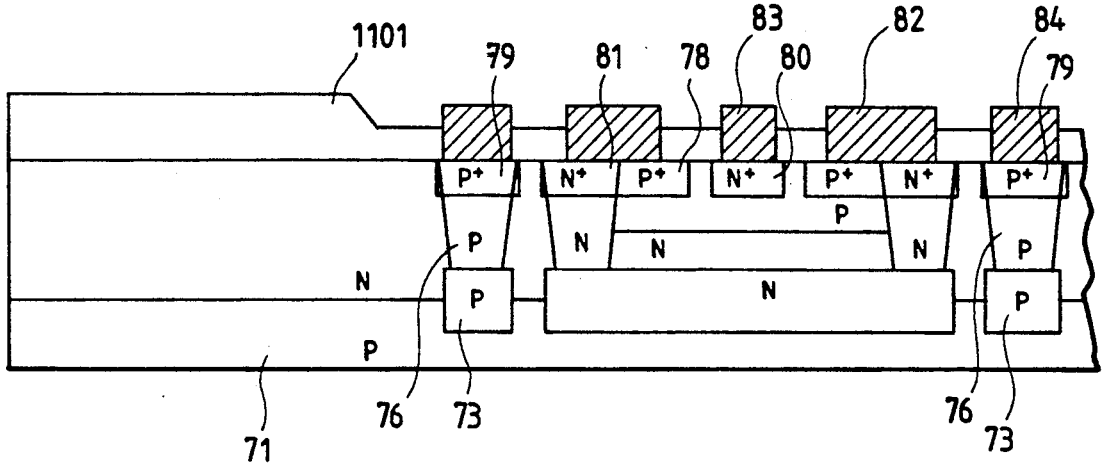

(5) Further, the silicone oxide film at the connecting position of each electrode was eliminated. Contact hole formed of Pure Al was deposited onto the whole surface. Al of the regions other than the electrode regions was eliminated. To raise the junction performance between Al and silicone, the alloy process was executed and the lower wiring portions 82, 83, 84 was formed (FIG. 11E).

Figure 11F:
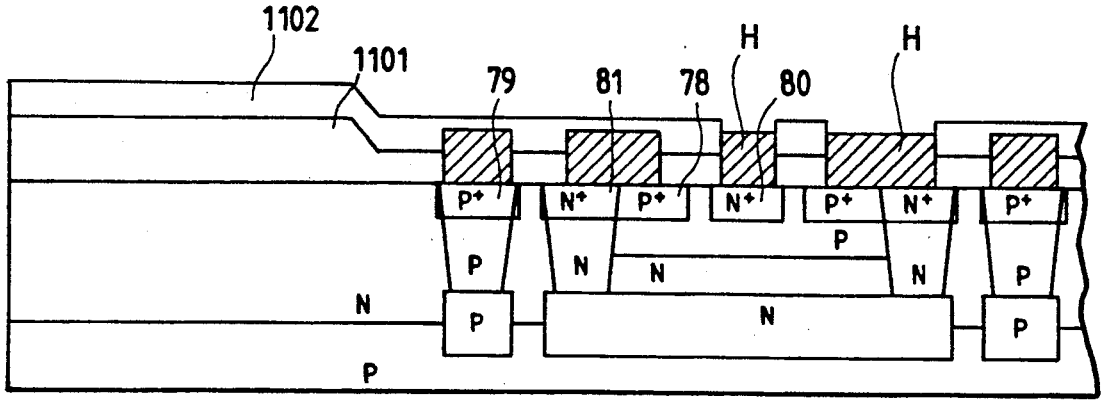

(6) A heat accumulation layer and an $SiO_2$ film 1102 serving as an interlayer insulative film each having a thickness of about 1.0 μm were formed on the whole surface by the sputtering process. Through hole H is formed by etching for electrical connection between emitter and base/collector (FIG. 11F).

Figure 11G:
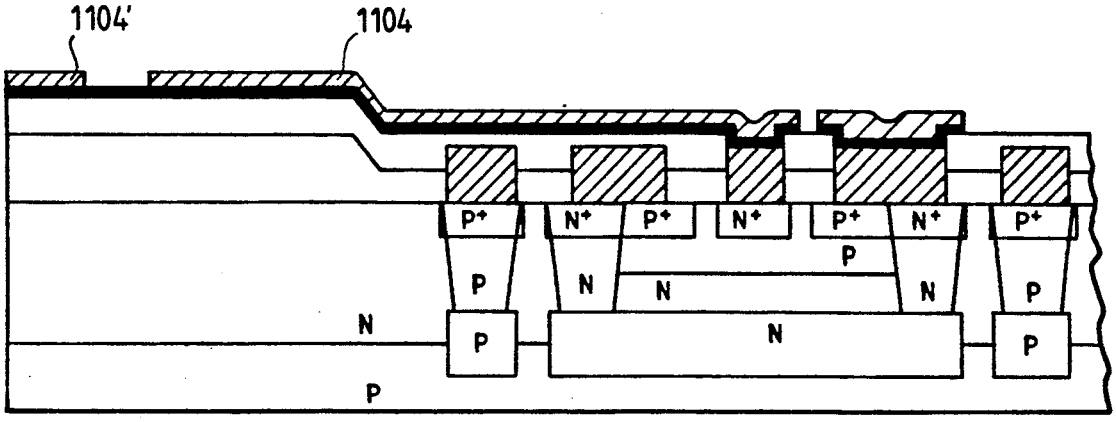

Then, $HfB_2$ of a thickness of about 1000 Å was deposited and patterned as the heat generation resistance layer 1103. A pair of electrodes 1104, 1104' of the electrothermal converting element are formed. And, for electrical connection between one electrode 1104 and emitter electrode 83, Al is deposited by sputtering. And, by etching for patterning each electrode and intermediate wiring, desired electrical connection is obtained (FIG. 11G).

Next, the protective layer of the electrothermal converting element and silicon oxide film 1105 serves as an insulating layer between the intermediate wiring and upper wiring formed thereon are deposited by sputtering.

Next, through hole is formed at the silicon oxide film 1105 by etching. Again, by Al deposition and patterning, upper wiring 1111 connected to base/collector electrode 82 via the intermediate Al layer is formed.

Thus, the isolation wiring is arranged at lower layer. The emitter (cathode) wiring and wiring of the electrothermal converting element are arranged at an intermediate positions.

Figure 11H:
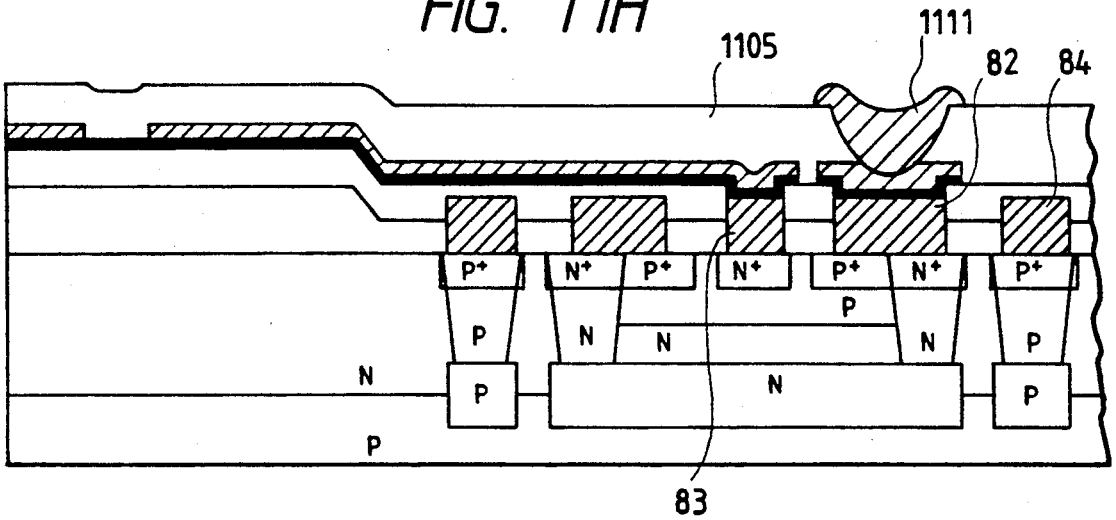

Base/collector (anode) wiring is arranged at an upper most position. Three layer wiring structure is achieved wherein each one is connected via two holes (FIG. 11H).

Figure 11I:
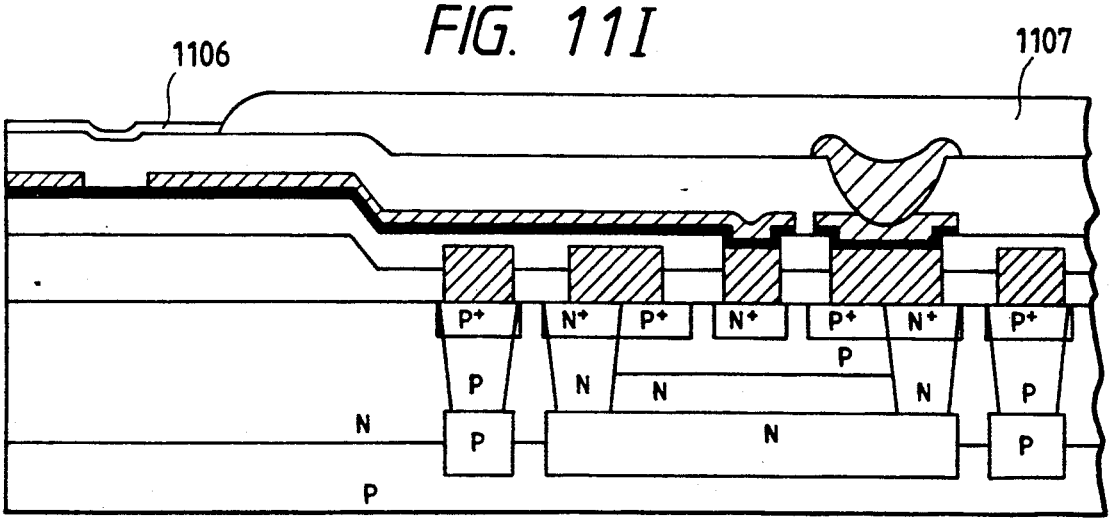
Figure 11J:
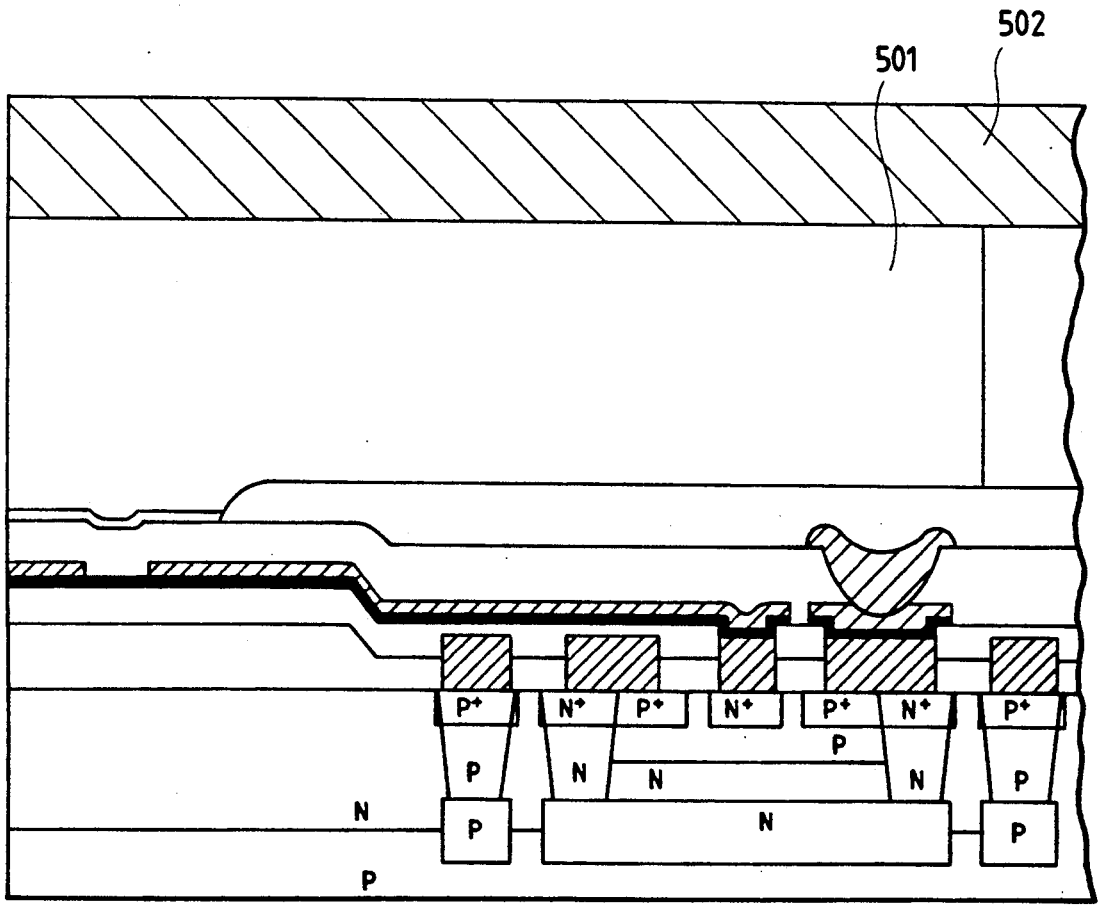

Next, as a protective layer for anti-cavitation, Ta layer 1106 of about 2000 Å is formed on the upper portion of the electrothermal converting element. On the other portion, as the protective layer, photo sensitive polyimide layer 1107 comprising organic material is formed (FIG. 11I).

The recording head is manufactured by providing the substrate having the electrothermal converting element and the semiconductor elements with the liquid path wall member 501 and the upper board 502.

With respect to the recording head using the semiconductor device which was manufactured as mentioned above, the cells having a plurality of semiconductor elements of FIG. 7B were connected like a matrix and the operation experiments were executed. In the operation experiments, eight semiconductor diodes were connected to one segment and a current of 300 mA (total 2.4 A) was allowed to flow through each diode. However, the other semiconductor diodes did not cause a malfunction and a liquid droplet could be properly discharged. The invention can be also applied to a PNP transistor construction.

Figure 12:
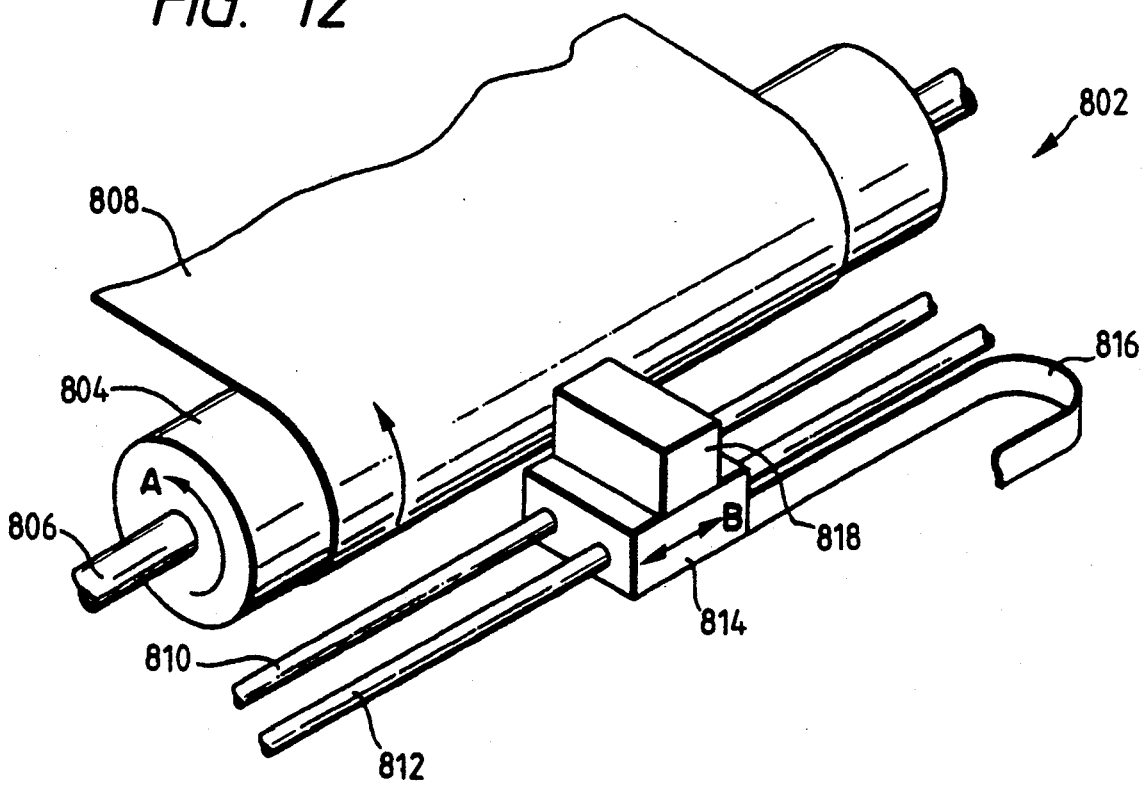
FIG. 12 is a schematic perspective view of an ink jet recording apparatus on which the recording head according to the present invention is mounted.

FIG. 12 is a diagrammatical perspective view of an ink jet recording apparatus in which the recording head of the invention is installed.

Means for conveying a recording paper 808 as a recording medium comprises a platen roller 804 and a shaft 806 to rotate the platen roller in the direction indicated by an arrow A. An ink tank integrated type head 818 is mounted on a carriage 814 which is guided by two guide shafts 810 and 812 and is reciprocated. The head 818 executes the recording by discharging an ink while moving along the recording paper surface. Reference numeral 816 denotes a flexible cable to transmit a drive signal to drive the electrothermal converting element of the recording head and a bias signal to bias the semiconductor substrate and the isolation regions.

Figure 13:
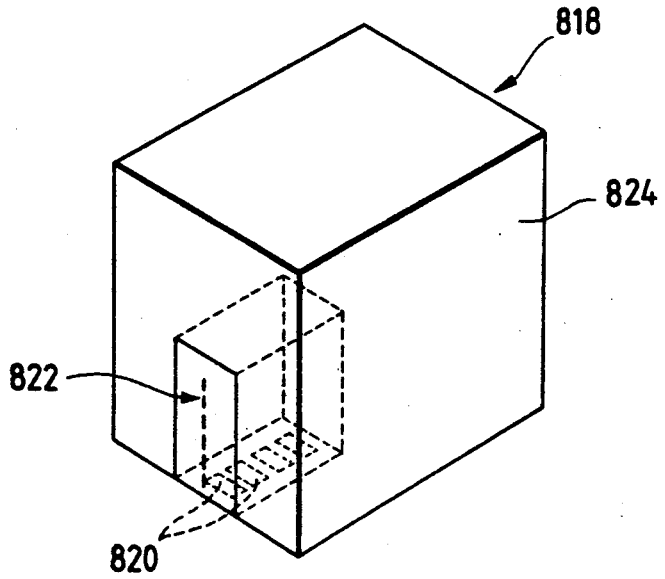
FIG. 13 shows the recording head configuration mounted on the apparatus of FIG. 12.

FIG. 13 shows the recording head 818. The head shown in FIG. 4A is assembled in an ink tank 824. An electric connecting terminal 820 is arranged in the lower portion of the head 818. Reference numeral 822 denotes a plurality of discharge ports to discharge the ink.

Figure 14:
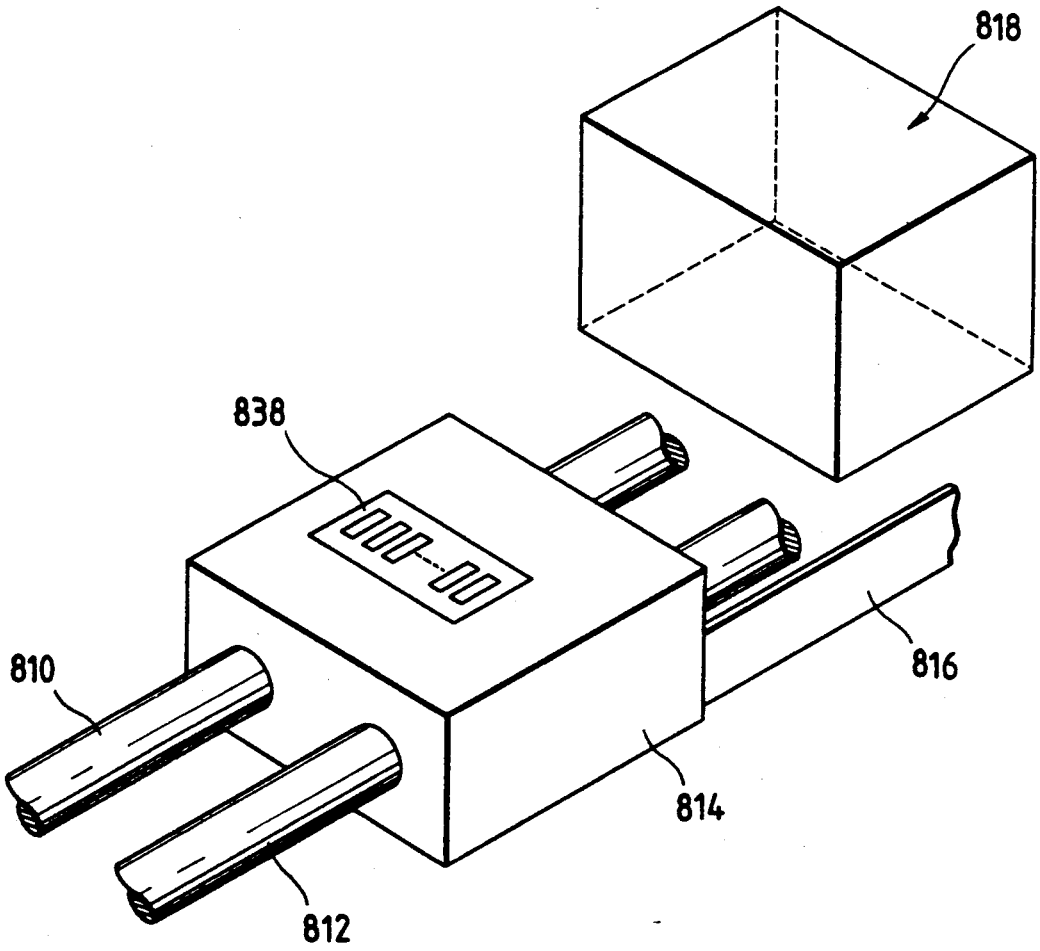
FIG. 14 shows a carriage configuration of FIG. 12.

The carriage 814 will now be described with reference to FIG. 14. Reference numeral 838 denotes a carriage side connecting terminal which is electrically connected to the flexible cable and is coupled to the connecting terminal 820 of the head 818. Each of the carriage side connecting terminal 838 and the head side connecting terminal 820 includes a contact to transmit the drive signal and a contact to transmit the bias signal.

EXAMPLES OF EXPERIMENTS

The heads in the foregoing first and second embodiments and the head as an example of the construction shown in U.S. Pat. No. 4,429,321 which had been shown as a conventional example were prepared. Each of the heads was driven by the drive signal of 300 mA and a pulse width of 10 μsec and the dot deviations of the discharged ink droplets were evaluated.

The evaluating method is as follows.

First, drive pulses were input a hundred times and the ink droplets were discharged from the same discharge port. The ink droplet which is located at the relatively longest distance was selected from among the ink droplets deposited onto the recording paper surface and such a distance is set to a maximum deviation $\sigma_{max}$. The head was continuously driven for one hour and the maximum deviations $\sigma_{max}$ were respectively calculated from the samples which were obtained in the states at the initial stage, after 10 minutes, after 30 minutes, and after one hour. The results are as follows.

| | Initial stage | After 10 min. | After 30 min. | After 1 hour |
|---|---|---|---|---|
| First embodiment | 85 | 85 | 95 | 95 |
| Second embodiment | 80 | 80 | 85 | 85 |
| Conventional example | 100 | 100 | 150 | 180 |

unit: μm (where, all of the diameters of the dots deposited were 100 μm)

As mentioned above, according to the embodiments of the invention, even when the heads were used for a long time, the discharge characteristics are stable and a good image is obtained. On the other hand, according to the conventional construction, although not so large a problem occurs at the initial stage, a problem occurs when the head is used for a long time.

Although the reasons of this are complicated, since the switching characteristics of the element are extremely good, the generation of micro air bubbles in the ink decreases and a film boiling phenomenon of a good controllability can be caused and remains stable for a long time.

As described above, according to the embodiment, with a plurality of semiconductor elements each having a high withstanding voltage and each of which is excellent in electrical isolation performance, every element can be formed on the single substrate. Therefore, for instance, in the circuit comprising the semiconductor elements which were connected like a matrix, there is no need to individually connect the elements from the outside and the number of steps can be reduced. Thus, the number of failure occurrence positions can be decreased and the high reliability can be assured.

On the other hand, according to the embodiment, the semiconductor element and the electric/thermal converting element which is driven by the semiconductor element can be formed on the same substrate. Therefore, it is possible to obtain the recording head in which the area of the circuit can be reduced, the number of steps can be decreased, the reliability can be improved, and a recording image of a high resolution can be formed.

The embodiment can be applied to semiconductor devices in various application fields. For instance, the embodiment can be also applied as a diode for a micro current. The embodiment can be also applied to a diode for a large current. However, as large advantages of the invention, there can be mentioned effects such that the semiconductor device of the embodiment is excellent in a withstanding voltage and can be used by a large current. Therefore, the most typical advantages of the embodiment can be obtained in the case where it is used as a device for a large current.

Further, in the case where a transistor is used as a semiconductor element, a drive voltage is applied to an emitter, a base and a collector are short-circuited, and an electric/thermal converting element is connected, since no minority carrier enters between the base and collector, the switching speed is high, the rising speed is improved, the parasitic effect is also lightened, a thermal energy suitable for a liquid can be applied, and good discharge characteristics can be obtained.

We claim:

1. An ink jet recording head comprising:

a plurality of discharge ports for discharging ink;

a plurality of electro-thermal converting elements for generating thermal energy which is used to discharge the ink; and a substrate provided with a semiconductor body which includes a plurality of transistors formed on a common semiconductor region of a first conductivity type, each of said transistors having a collector region of a second conductivity type, a base region of the first conductivity type formed within said collector region, and an emitter region of the second conductivity type formed within said base region, and each of said transistors being connected with a respective one of said electro-thermal converting elements, said semiconductor body also including an isolation semiconductor region of the first conductivity type contiguous with said common semiconductor region provided between a pair of said transistors, wherein the base and the collector regions of each transistor are short-circuited, and said isolation semiconductor region includes a contact for connecting said isolation semiconductor region with a reference potential source.

2. An ink jet recording head comprising:

a plurality of discharge ports for discharging ink;

a plurality of electro-thermal converting elements for generating thermal energy which is used to discharge the ink; and a substrate provided with a semiconductor body which includes a plurality of transistors formed on a common semiconductor region of a first conductivity type, each of said transistors having a collector region of a second conductivity type, a base region of the first conductivity type formed within said collector region, and an emitter region of the second conductivity type formed within said base region, said semiconductor body also including an isolation semiconductor region of the first conductivity type contiguous with said common semiconductor region provided between a pair of said transistors, wherein the base and the collector regions of each transistor are short-circuited, the emitter region is connected with a respective one of said electro-thermal converting elements, and said isolation semiconductor region includes a contact for connecting said isolation semiconductor region with a reference potential source.

3. A head according to claim 1 or 2, wherein each transistor comprises an NPN type transistor.

4. A head according to claim 1 or 2, wherein each transistor element comprises a PNP type transistor.

5. A head according to claim 2, wherein said semiconductor body comprises a P type semiconductor substrate as said common semiconductor region and each transistor is formed in a semiconductor region which exists on said semiconductor substrate, said semiconductor region being formed by an epitaxial growth.

6. A head according to claim 1, wherein said semiconductor body comprises an N type semiconductor substrate as said common semiconductor region and each transistor is formed in a semiconductor region which exists on said semiconductor substrate, said semiconductor region being formed by an epitaxial growth.

7. A head according to claim 1, wherein said semiconductor body comprises an N type semiconductor substrate as said common semiconductor region and each transistor is formed in a semiconductor region which exists on said semiconductor substrate, said semiconductor region having a circumference surrounded by said isolation semiconductor region which comprises an N type semiconductor, and said isolation semiconductor region is held at a positive potential.

8. A head according to claim 2, wherein said semiconductor body comprises a P type semiconductor substrate as said common semiconductor region and each transistor is formed in a semiconductor region which exists on said semiconductor substrate, said semiconductor region having a circumference surrounded by said isolation semiconductor region which comprises a P type semiconductor, and said isolation semiconductor region is held at ground potential.

9. A head according to claim 1, wherein said semiconductor body comprises an N type semiconductor substrate as said common semiconductor region and each transistor is formed on said semiconductor substrate having an impurity concentration which lies within a range from $1\times10^{12}$ to $1\times10^{16}$ $cm^{-3}$.

10. A head according to claim 2, wherein said semiconductor body comprises a P type semiconductor substrate as said common semiconductor region and each transistor is formed on said semiconductor substrate having an impurity concentration which lies within a range from $1\times10^{12}$ to $1\times10^{16}$ $cm^{-3}$.

11. A head according to claim 1 or 2, wherein each electrothermal converting element is formed as a thin film through an insulative film on said common semiconductor region on which said transistor elements are formed.

12. A head according to claim 1 or 2, wherein said plurality of said electrothermal converting elements and said plurality of said transistors are connected in a matrix.

13. A head according to claim 2, wherein in each transistor, said collector region comprises an N type semiconductor having an impurity concentration of $1\times10^{19}\,cm^{-3}$ or more; and said base region comprises a P type semiconductor having an impurity concentration which lies within a range from $1\times10^{13}$ to $1\times10^{15}\,cm^{-3}$.

14. An ink jet recording head according to claim 1, wherein each transistor element is formed within said substrate.

15. An ink jet recording head according to claim 2, wherein each transistor element is formed within said substrate.

16. An ink jet recording apparatus comprising:

an ink jet recording head including a plurality of discharge ports for discharging ink, a plurality of electro-thermal converting elements for generating thermal energy which is used to discharge the ink, and a substrate provided with a semiconductor body which includes a plurality of transistors formed on a common semiconductor region of a first conductivity type, each of said transistors having a collector region of a second conductivity type, a base region of the first conductivity type formed within said collector region, and an emitter region of the second conductivity type formed within said base region, and each of said transistors being connected with a respective one of said electro-thermal converting elements, said semiconductor body also including an isolation semiconductor region of the first conductivity type contiguous with said common semiconductor region provided between a pair of said transistors, wherein the base and the collector regions of each transistor are short-circuited;

a carriage for mounting said ink jet recording head;

means for conveying a recording medium to said recording head; and connecting means for connecting said isolation semiconductor region with a reference potential.

17. An ink jet recording apparatus comprising:

an ink jet recording head including a plurality of discharge ports for discharging ink, a plurality of electro-thermal converting elements for generating thermal energy which is used to discharge the ink, and a substrate provided with a semiconductor body which includes a plurality of transistors formed on a common semiconductor region of a first conductivity type, each of said transistors having a collector region of a second conductivity type, a base region of the first conductivity type formed within said collector region, and an emitter region of the second conductivity type formed within said base region, each of said transistors being connected with a respective one of said electro-thermal converting elements, said semiconductor body also including an isolation semiconductor region of the first conductivity type contiguous with said common semiconductor region provided between a pair of said transistors, wherein the base and the collector regions of each transistor are short-circuited;

a carriage for mounting said ink jet head;

means for conveying a recording medium to said recording head; and connecting means for connecting said isolation semiconductor region with a reference potential, connecting an emitter of each transistor selectively to a first potential and connecting an electrode of each electro-thermal converting element selectively to a second potential.

18. An ink jet recording apparatus comprising:

an ink jet recording head including a plurality of discharge ports for discharging ink, a plurality of electro-thermal converting elements for generating thermal energy which is used to discharge the ink, and a substrate provided with a semiconductor body which includes a plurality of transistors formed on a common semiconductor region of a first conductivity type, each of said transistors having a collector region of a second conductivity type, a base region of the first conductivity type formed within said collector region, and an emitter region of the second conductivity type formed within said base region, the emitter region of each of said transistors being connected with a respective one of said electro-thermal converting elements, said semiconductor body also including an isolation semiconductor region of the first conductivity type contiguous with said common semiconductor region provided between a pair of said transistors, wherein the base and the collector regions of each transistor are short-circuited;

a carriage for mounting said ink jet recording head;

means for conveying a recording medium to said recording head; and connecting means for connecting said isolation semiconductor region with a reference potential, connecting the base and collector regions of each transistor selectively to a first potential and connecting an electrode of each electro-thermal converting element selectively to a second potential.

* * * * *

UNITED STATES PATENT AND TRADEMARK OFFICE

CERTIFICATE OF CORRECTION

PATENT NO. : 5,216,447

DATED : June 1, 1993

INVENTOR(S) : KEI FUJITA, ET AL.

It is certified that error appears in the above-identified patent and that said Letters Patent is hereby corrected as shown below:

COLUMN 1

Line 6, "recording." should read --recording--.

COLUMN 3

Line 5, "Further" should read --A further--.

COLUMN 4

Line 5, "to" should read --to the--.
Line 8, "to" should read --to the--.
Line 10, "of" should read --of a--.
Line 16, "of" should read --of the--.
Line 34, "shows" should read --shows the--.
Line 36, "and" should be deleted.
Line 39, "invention." should read --invention;--.

COLUMN 5

Line 15, "are" should read --is--.
Line 34, "with" should read --with the--.
Line 36, "$R_{5B}$" should read --$R_B$--.

COLUMN 6

Line 6, "current" should read --current is--.
Line 52, "While," should read --Meanwhile,--.
Line 68, "port" should read --port,--.

UNITED STATES PATENT AND TRADEMARK OFFICE

CERTIFICATE OF CORRECTION

PATENT NO. : 5,216,447

DATED : June 1, 1993

INVENTOR(S) : KEI FUJITA, ET AL.

It is certified that error appears in the above-identified patent and that said Letters Patent is hereby corrected as shown below:

COLUMN 7

Line 19, "the." should read --the--.
Line 44, "a" (last occurrence) should be deleted.
Line 53, "as," should read --as--.

COLUMN 8

Line 8, "1 kΩ/Є" should read --1 kΩ/□--.
Line 15, "$1\times10^{16}cm^{313}$" should read --$1\times10^{16}cm^{-3}$--.

COLUMN 11

Line 47, "necessary." should read --is necessary.--.

COLUMN 12

Line 22, "function" should read --functional--.
Line 65, "MXN" should read --M×N--.
Line 67, "in the one of" should read --in one--.

COLUMN 13

Line 18, "at" should read --at the--.
Line 28, "itself" should read --itself is-- and
"to" should read --to the--.
Line 34, "view of the" should read --this--.
Line 42, "is required" should read --requires--.
Line 53, "a" (last occurrence) should be deleted.
Line 61, "30 Ω/}" should read --30 Ω/□--.

UNITED STATES PATENT AND TRADEMARK OFFICE

CERTIFICATE OF CORRECTION

PATENT NO. : 5,216,447

DATED : June 1, 1993

INVENTOR(S) : KEI FUJITA, ET AL.

It is certified that error appears in the above-identified patent and that said Letters Patent is hereby corrected as shown below:

COLUMN 14

Line 29, "P+" should read $P^+$--.
Line 30, "ions" should read --ions.--.
Line 46, "N+" should read --$N^+$--.

COLUMN 15

Line 13, "serves" should read --serving--.
Line 17, "Next," should read --Next, a--.
Line 21, "at" should read --at the--.
Line 23, "an" should be deleted.

COLUMN 16

Line 16, "had" should read --has--.

Signed and Sealed this

Twenty-first Day of June, 1994

Bruce Lehman

BRUCE LEHMAN

*Commissioner of Patents and Trademarks*

*Attest:*

*Attesting Officer*